US012655743B2

(12) United States Patent
Ma et al.

(10) Patent No.: US 12,655,743 B2
(45) Date of Patent: Jun. 16, 2026

(54) GEOLOGIC PORE SYSTEM CHARACTERIZATION FRAMEWORK

(71) Applicant: Schlumberger Technology Corporation, Sugar Land, TX (US)

(72) Inventors: Jun Tao Ma, Beijing (CN); Lin Liang, Cambridge, MA (US); Xi Yan, Beijing (CN); Gong Rui Yan, Beijing (CN); Marie Van Steene, Dhahran (SA); Wael Abdallah, Dhahran (SA); Shouxiang Ma, Dhahran (SA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 391 days.

(21) Appl. No.: 18/494,878

(22) Filed: Oct. 26, 2023

(65) Prior Publication Data

US 2024/0141773 A1 May 2, 2024

Related U.S. Application Data

(60) Provisional application No. 63/419,983, filed on Oct. 27, 2022.

(51) Int. Cl.
*E21B 47/00* (2012.01)
*E21B 47/003* (2012.01)
*E21B 47/01* (2012.01)

(52) U.S. Cl.
CPC ..... *E21B 47/003* (2020.05); *E21B 47/01* (2013.01)

(58) Field of Classification Search
CPC ..... E21B 47/003; E21B 47/01; G01V 3/32
USPC ..... 705/1.1–912; 166/242.1, 250.01, 254.2; 175/40; 324/303, 338
See application file for complete search history.

(56) References Cited

U.S. PATENT DOCUMENTS

2013/0185032 A1* 7/2013 Archer ..... G01V 1/306 703/2
2017/0371072 A1 12/2017 Shetty
2022/0003696 A1* 1/2022 Elsayed ..... G01N 24/081

FOREIGN PATENT DOCUMENTS

NO 348938 B1 * 7/2025 ..... G01V 3/38

OTHER PUBLICATIONS

Jorge O. Parra, Chris Hackert, Michael Bennett, Hughbert A. Collier; Permeability and porosity images based on NMR, sonic, and seismic reflectivity: Application to a carbonate aquifer. The Leading Edge 2003; 22 (11): 1102-1108. (Year: 2003).*
Lawrence M. Anovitz, David R. Cole; Characterization and Analysis of Porosity and Pore Structures. Reviews in Mineralogy and Geochemistry 2015; 80 (1): 61-164. (Year: 2015).*
Jain et al., "Characterization of underlying pore and fluid structure using factor analysis on NMR data", SPWLA 54th Annual Logging Symposium, Jun. 2013.

(Continued)

*Primary Examiner* — Jonathan P Ouellette
(74) *Attorney, Agent, or Firm* — Kyle R. Miiller

(57) ABSTRACT

A method may include acquiring NMR data and sonic data for a borehole in a subsurface geologic region; inverting the NMR data and the sonic data to determine volume fractions for a number of classes of pore types, where the classes include shape and size-based classes; and characterizing the subsurface geologic region based on the volume fractions for the number of classes.

21 Claims, 14 Drawing Sheets

(56) References Cited

OTHER PUBLICATIONS

Clerke et al., "Wireline spectral porosity analysis of the Arab Limestone—From Rosetta Stone to Cipher", SPWLA 55th Annual Logging Symposium, May 2014.
Xu et al., "Modeling elastic properties in carbonate rocks", The Leading Edge, 28(1), 2009, pp. 66-74.
Mehrabi et al., "Imaging and quantification of the pore microstructure of gas shales using X-ray microtomography", Solid Earth Discussions, Doi: https://doi.org/10.5194/se-2017-52, 2017, 17 Pages.
Ojala, "Using rock physics for constructing synthetic sonic logs", Proceedings of the 3rd CANUS Rock Mechanics Symposium, May 2009, 10 pages.
Weisstein, Eric W. "Oblate Spheroid." From MathWorld—A Wolfram Web Resource. https://mathworld.wolfram.com/OblateSpheroid.html, 2003, 4 Pages.
Weisstein, Eric W. "Prolate Spheroid." From MathWorld—A Wolfram Web Resource. https://mathworld.wolfram.com/ProlateSpheroid.html, 2003, 3 pages.
Weisstein, Eric W. "Cuboid." From MathWorld—A Wolfram Web Resource. https://mathworld.wolfram.com/Cuboid.html, 2002, 3 pages.
Weisstein, Eric W. "Capsule." From MathWorld—A Wolfram Web Resource. https://mathworld.wolfram.com/Capsule.html, 2 pages.
Weisstein, Eric W. "Stadium." From MathWorld—A Wolfram Web Resource. https://mathworld.wolfram.com/Stadium.html, 2 pages.

* cited by examiner

600

| | |
|---|---|
| FCRK_MA+FREF_MA+FSTF_MA+FCRK_MI+FREF_MI+FSTF_MI | = 1 |
| (FCRK_MA+FREF_MA+FSTF_MA) * PHIT | = PHI_MACRO |
| (FCRK_MI+FREF_MI+FSTF_MI) * PHIT | = PHI_MICRO |
| (FCRK_MA+FRCK_MI) | = FCRK |
| (FREF_MA+FREF_MI) | = FREF |
| (FSTF_MA+FSTF_MI) | = FSTF |

$$a = b > c$$

$$Aspect\ Ratio\ (AR) = \frac{c}{a}$$

$$V = \frac{4}{3}\pi abc$$

$$S_{oblate} = 2\pi a^2\left(1 + \frac{1-e^2}{e}tanh^{-1}e\right), e^2 = 1 - \frac{c^2}{a^2}$$

$$\xi_{oblate} = \frac{3}{2c}\left(1 + \frac{1-e^2}{e}tanh^{-1}e\right)$$

$$\xi_{oblate} = \frac{S}{V} = \frac{1}{T_2\rho_2}$$

$$a \times c = \frac{\left[\frac{3}{2\xi_{oblate}}\left(1 + \frac{1-e^2}{e}tanh^{-1}e\right)\right]^2}{AR}$$

GEOLOGIC PORE SYSTEM CHARACTERIZATION FRAMEWORK

RELATED APPLICATIONS

This application claims priority to and the benefit of a U.S. Provisional Application having Ser. No. 63/419,983, filed 27 Oct. 2022, which is incorporated by reference herein in its entirety.

BACKGROUND

A reservoir may be a subsurface formation that may be characterized at least in part by its porosity and/or fluid permeability. As an example, a reservoir may be part of a basin such as a sedimentary basin. A basin may be a depression (e.g., caused by plate tectonic activity, subsidence, etc.) in which sediments accumulate. As an example, where hydrocarbon source rocks occur in combination with appropriate depth and duration of burial, a petroleum system may develop within a basin, which may form a reservoir that includes hydrocarbon fluids (e.g., oil, gas, etc.).

SUMMARY

A method may include acquiring NMR data and sonic data for a borehole in a subsurface geologic region; inverting the NMR data and the sonic data to determine volume fractions for a number of classes of pore types, where the classes include shape and size-based classes; and characterizing the subsurface geologic region based on the volume fractions for the number of classes. A system may include a processor; memory accessible to the processor; processor-executable instructions stored in the memory and executable by the processor to instruct the system to: acquire NMR data and sonic data for a borehole in a subsurface geologic region; invert the NMR data and the sonic data to determine volume fractions for a number of classes of pore types, where the classes include shape and size-based classes; and characterize the subsurface geologic region based on the volume fractions for the number of classes. One or more computer-readable media may include computer-executable instructions executable by a system to instruct the system to: acquire NMR data and sonic data for a borehole in a subsurface geologic region; invert the NMR data and the sonic data to determine volume fractions for a number of classes of pore types, where the classes include shape and size-based classes; and characterize the subsurface geologic region based on the volume fractions for the number of classes. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations may be more readily understood by reference to the following description taken in conjunction with the accompanying drawings.

DETAILED DESCRIPTION

This description is not to be taken in a limiting sense, but rather is made merely for the purpose of describing the general principles of the implementations. The scope of the described implementations should be ascertained with reference to the issued claims.

Figure 1:
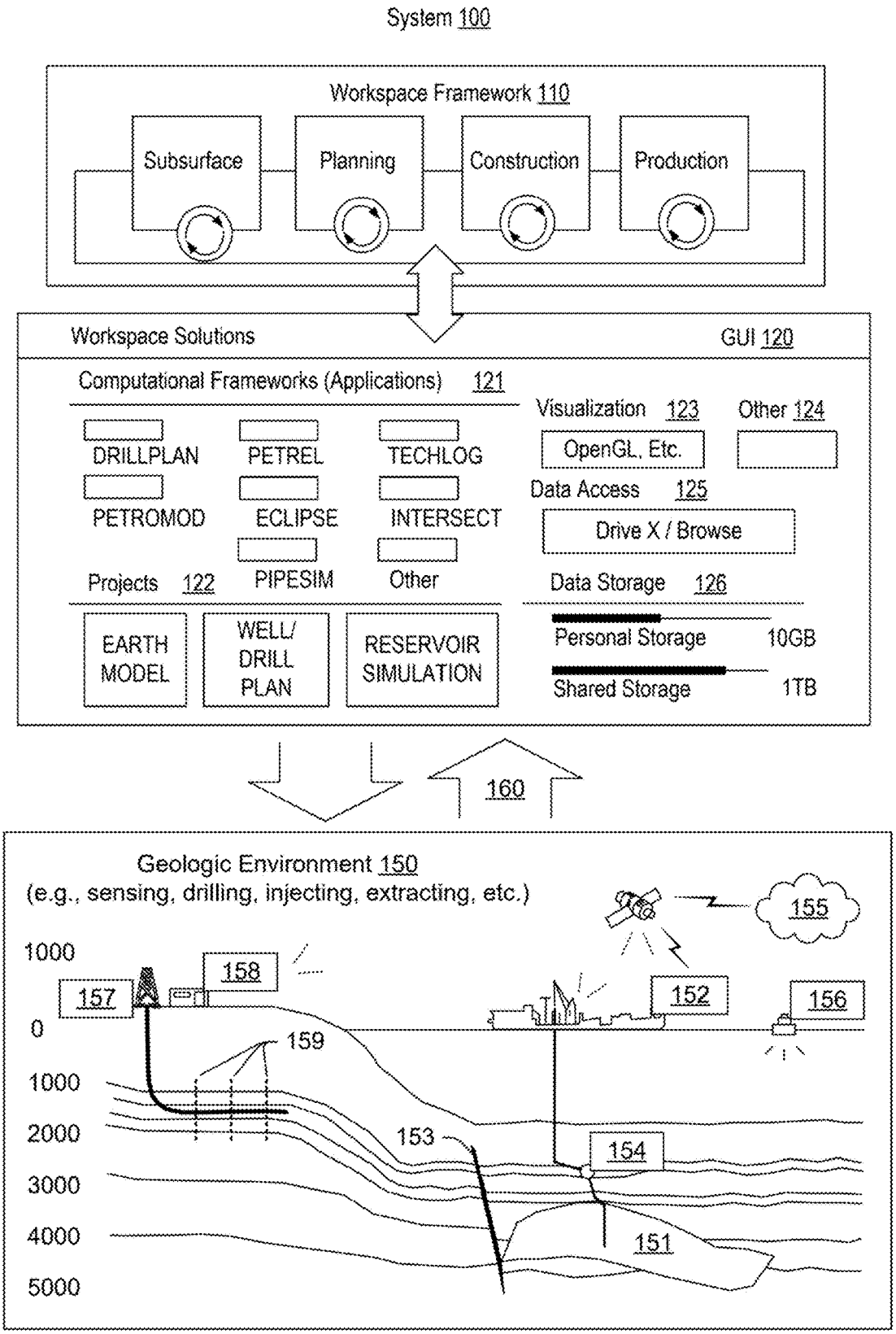
FIG. 1 illustrates an example system that includes various framework components associated with one or more geologic environments.

FIG. 1 shows an example of a system 100 that includes a workspace framework 110 that may provide for instantiation of, rendering of, interactions with, etc., a graphical user interface (GUI) 120. In the example of FIG. 1, the GUI 120 may include graphical controls for computational frameworks (e.g., applications) 121, projects 122, visualization features 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, PETREL, TECHLOG, PETROMOD, ECLIPSE, PIPESIM, and INTERSECT frameworks (Schlumberger Limited, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The PETREL framework may be part of the DELFI cognitive E&P environment (Schlumberger Limited, Houston, Texas) for utilization in geosciences and geoengineering, for example, to analyze subsurface data from exploration to production of fluid from a reservoir.

The TECHLOG framework may handle and process field and laboratory data for a variety of geologic environments (e.g., deepwater exploration, shale, etc.). The TECHLOG framework may structure wellbore data for analyses, planning, etc.

The PETROMOD framework provides petroleum systems modeling capabilities that may combine one or more of seismic, well, and geological information to model the evolution of a sedimentary basin. The PETROMOD framework may predict if, and how, a reservoir has been charged with hydrocarbons, including the source and timing of hydrocarbon generation, migration routes, quantities, and hydrocarbon type in the subsurface or at surface conditions.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework may produce reliable results, which may be continuously updated by real-time data exchanges (e.g., from one or more types of data acquisition equipment in the field that may acquire data during one or more types of field operations, etc.). The INTERSECT framework may provide completion configurations for complex wells where such configurations may be built in the field, may provide detailed chemical-enhanced-oil-recovery (EOR) formulations where such formulations may be implemented in the field, may analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI cognitive E&P environment, for example, for rapid simulation of multiple concurrent cases. For example, a workflow may utilize one or more of the DELFI on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 may be utilized for directing, controlling, etc., one or more processes in the geologic environment 150, and feedback 160 may be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G software packages. Examples of such software packages include the PETREL framework. As an example, a system or systems may utilize a framework such as the DELFI framework (Schlumberger Limited, Houston, Texas). Such a framework may operatively couple various other frameworks to provide for a multi-framework workspace. As an example, the GUI 120 of FIG. 1 may be a GUI of the DELFI framework.

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, a visualization process may implement one or more of various features that may be suitable for one or more web applications. For example, a template may involve use of the JAVASCRIPT object notation format (JSON) and/or one or more other languages/formats. As an example, a framework may include one or more converters. For example, consider a JSON to PYTHON converter and/or a PYTHON to JSON converter. Such an approach may provide for compatibility of devices, frameworks, etc., with respect to one or more sets of instructions.

As an example, visualization features may provide for visualization of various earth models, properties, etc., in one or more dimensions. As an example, visualization features may provide for rendering of information in multiple dimensions, which may optionally include multiple resolution rendering. In such an example, information being rendered may be associated with one or more frameworks and/or one or more data stores. As an example, visualization features may include one or more control features for control of equipment, which may include, for example, field equipment that may perform one or more field operations. As an example, a workflow may utilize one or more frameworks to generate information that may be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results may be utilized to plan, simulate, perform, etc., one or more operations for production of fluid from a reservoir (e.g., reservoir rock, etc.).

Field acquisition equipment may be utilized to acquire seismic data, which may be in the form of traces where a trace may include values organized with respect to time and/or depth (e.g., consider 1D, 2D, 3D or 4D seismic data). For example, consider acquisition equipment that acquires digital samples at a rate of one sample per approximately 4 ms. Given a speed of sound in a medium or media, a sample rate may be converted to an approximate distance. For example, the speed of sound in rock may be on the order of around 5 km per second. Thus, a sample time spacing of approximately 4 ms would correspond to a sample "depth" spacing of about 10 meters (e.g., assuming a path length from source to boundary and boundary to sensor). As an example, a trace may be about 4 seconds in duration; thus, for a sampling rate of one sample at about 4 ms intervals, such a trace would include about 1000 samples where latter acquired samples correspond to deeper reflection boundaries. If the 4 second trace duration of the foregoing example is divided by two (e.g., to account for reflection), for a vertically aligned source and sensor, a deepest boundary depth may be estimated to be about 10 km (e.g., assuming a speed of sound of about 5 km per second).

As an example, a model may be a simulated version of a geologic environment. As an example, a simulator may include features for simulating physical phenomena in a geologic environment based at least in part on a model or models. A simulator, such as a reservoir simulator, may simulate fluid flow in a geologic environment based at least in part on a model that may be generated via a framework that receives seismic data. A simulator may be a computerized system (e.g., a computing system) that may execute instructions using one or more processors to solve a system of equations that describe physical phenomena subject to various constraints. In such an example, the system of equations may be spatially defined (e.g., numerically discretized) according to a spatial model that includes layers of rock, geobodies, etc., that have corresponding positions that may be based on interpretation of seismic and/or other data. A spatial model may be a cell-based model where cells are defined by a grid (e.g., a mesh). A cell in a cell-based model may represent a physical area or volume in a geologic environment where the cell may be assigned physical properties (e.g., permeability, fluid properties, etc.) that may be germane to one or more physical phenomena (e.g., fluid volume, fluid flow, pressure, etc.). A reservoir simulation model may be a spatial model that may be cell-based.

A simulator may be utilized to simulate the exploitation of a real reservoir, for example, to examine different productions scenarios to find an optimal one before production or further production occurs. A reservoir simulator does not provide an exact replica of flow in and production from a reservoir at least in part because the description of the reservoir and the boundary conditions for the equations for flow in a porous rock are generally known with an amount of uncertainty. Certain types of physical phenomena occur at a spatial scale that may be relatively small compared to size of a field. A balance may be struck between model scale and computational resources that results in model cell sizes being of the order of meters; rather than a lesser size (e.g., a level of detail of pores). A modeling and simulation workflow for multiphase flow in porous media (e.g., reservoir rock, etc.) may include generalizing real micro-scale data from macro scale observations (e.g., seismic data and well data) and upscaling to a manageable scale and problem size. Uncertainties may exist in input data and solution procedure such that simulation results too are to some extent uncertain. A process known as history matching may involve comparing simulation results to actual field data acquired during production of fluid from a field. Information gleaned from history matching, may provide for adjustments to a model, data, etc., which may help to increase accuracy of simulation.

As an example, a simulator may utilize various types of constructs, which may be referred to as entities. Entities may include earth entities or geological objects such as wells, surfaces, reservoirs, etc. Entities may include virtual representations of actual physical entities that may be reconstructed for purposes of simulation. Entities may include entities based on data acquired via sensing, observation, etc. (e.g., consider entities based at least in part on seismic data and/or other information). As an example, an entity may be characterized by one or more properties (e.g., a geometrical pillar grid entity of an earth model may be characterized by a porosity property, etc.). Such properties may represent one or more measurements (e.g., acquired data), calculations, etc.

As an example, a simulator may utilize an object-based software framework, which may include entities based on pre-defined classes to facilitate modeling and simulation. As an example, an object class may encapsulate reusable code and associated data structures. Object classes may be used to instantiate object instances for use by a program, script, etc. For example, borehole classes may define objects for representing boreholes based on well data. A model of a basin, a reservoir, etc. may include one or more boreholes where a borehole may be, for example, for measurements, injection, production, etc. As an example, a borehole may be a wellbore of a well, which may be a completed well (e.g., for production of a resource from a reservoir, for injection of material, etc.).

While several simulators are illustrated in the example of FIG. 1, one or more other simulators may be utilized, additionally or alternatively. For example, consider the VISAGE geomechanics simulator (Schlumberger Limited, Houston Texas) or the PIPESIM network simulator (Schlumberger Limited, Houston Texas), etc. The VISAGE simulator includes finite element numerical solvers that may provide simulation results such as, for example, results as to compaction and subsidence of a geologic environment, well and completion integrity in a geologic environment, caprock and fault-seal integrity in a geologic environment, fracture behavior in a geologic environment, thermal recovery in a geologic environment, $CO_2$ disposal, etc. The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (Schlumberger Limited, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that may optimize one or more operational scenarios at least in part via simulation of physical phenomena. The MANGROVE simulator (Schlumberger Limited, Houston, Texas) provides for optimization of stimulation design (e.g., stimulation treatment operations such as hydraulic fracturing) in a reservoir-centric environment. The MANGROVE framework may combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well). The MANGROVE framework may provide results pertaining to heterogeneous interactions between hydraulic and natural fracture networks, which may assist with optimization of the number and location of fracture treatment stages (e.g., stimulation treatment(s)), for example, to increased perforation efficiency and recovery.

The PETREL framework provides components that allow for optimization of exploration and development operations. The PETREL framework includes seismic to simulation software components that may output information for use in increasing reservoir performance, for example, by improving asset team productivity. Through use of such a framework, various professionals (e.g., geophysicists, geologists, and reservoir engineers) may develop collaborative workflows and integrate operations to streamline processes (e.g., with respect to one or more geologic environments, etc.). Such a framework may be considered an application (e.g., executable using one or more devices) and may be considered a data-driven application (e.g., where data is input for purposes of modeling, simulating, etc.).

As mentioned, a framework may be implemented within or in a manner operatively coupled to the DELFI cognitive exploration and production (E&P) environment (Schlumberger, Houston, Texas), which is a secure, cognitive, cloud-based collaborative environment that integrates data and workflows with digital technologies, such as artificial intelligence and machine learning. As an example, such an environment may provide for operations that involve one or more frameworks. The DELFI environment may be referred to as the DELFI framework, which may be a framework of frameworks. As an example, the DELFI framework may include various other frameworks, which may include, for example, one or more types of models (e.g., simulation models, etc.).

As an example, data may include geochemical data. For example, consider data acquired using X-ray fluorescence (XRF) technology, Fourier transform infrared spectroscopy (FTIR) technology and/or wireline geochemical technology.

As an example, one or more probes may be deployed in a bore via a wireline or wirelines and/or via a drillstring. As an example, a probe may emit energy and receive energy where such energy may be analyzed to help determine mineral composition of rock surrounding a bore. As an example, nuclear magnetic resonance may be implemented (e.g., via a wireline, downhole NMR probe, etc.), for example, to acquire data as to nuclear magnetic properties of elements in a formation (e.g., hydrogen, carbon, phosphorous, etc.).

As an example, lithology scanning technology may be employed to acquire and analyze data. For example, consider the LITHO SCANNER technology marketed by Schlumberger Limited (Houston, Texas). As an example, a LITHO SCANNER tool may be a gamma ray spectroscopy tool.

As an example, a tool may be positioned to acquire information in a portion of a borehole. Analysis of such information may reveal vugs, dissolution planes (e.g., dissolution along bedding planes), stress-related features, dip events, etc. As an example, a tool may acquire information that may help to characterize a fractured reservoir, optionally where fractures may be natural and/or artificial (e.g., hydraulic fractures). Such information may assist with completions, stimulation treatment, etc. As an example, information acquired by a tool may be analyzed using a framework such as the aforementioned TECHLOG framework (Schlumberger Limited, Houston, Texas).

As an example, a workflow may utilize one or more types of data for one or more processes (e.g., stratigraphic modeling, basin modeling, completion designs, drilling, production, injection, etc.). As an example, one or more tools may provide data that may be used in a workflow or workflows that may implement one or more frameworks (e.g., PETREL, TECHLOG, PETROMOD, ECLIPSE, etc.).

Figure 2:
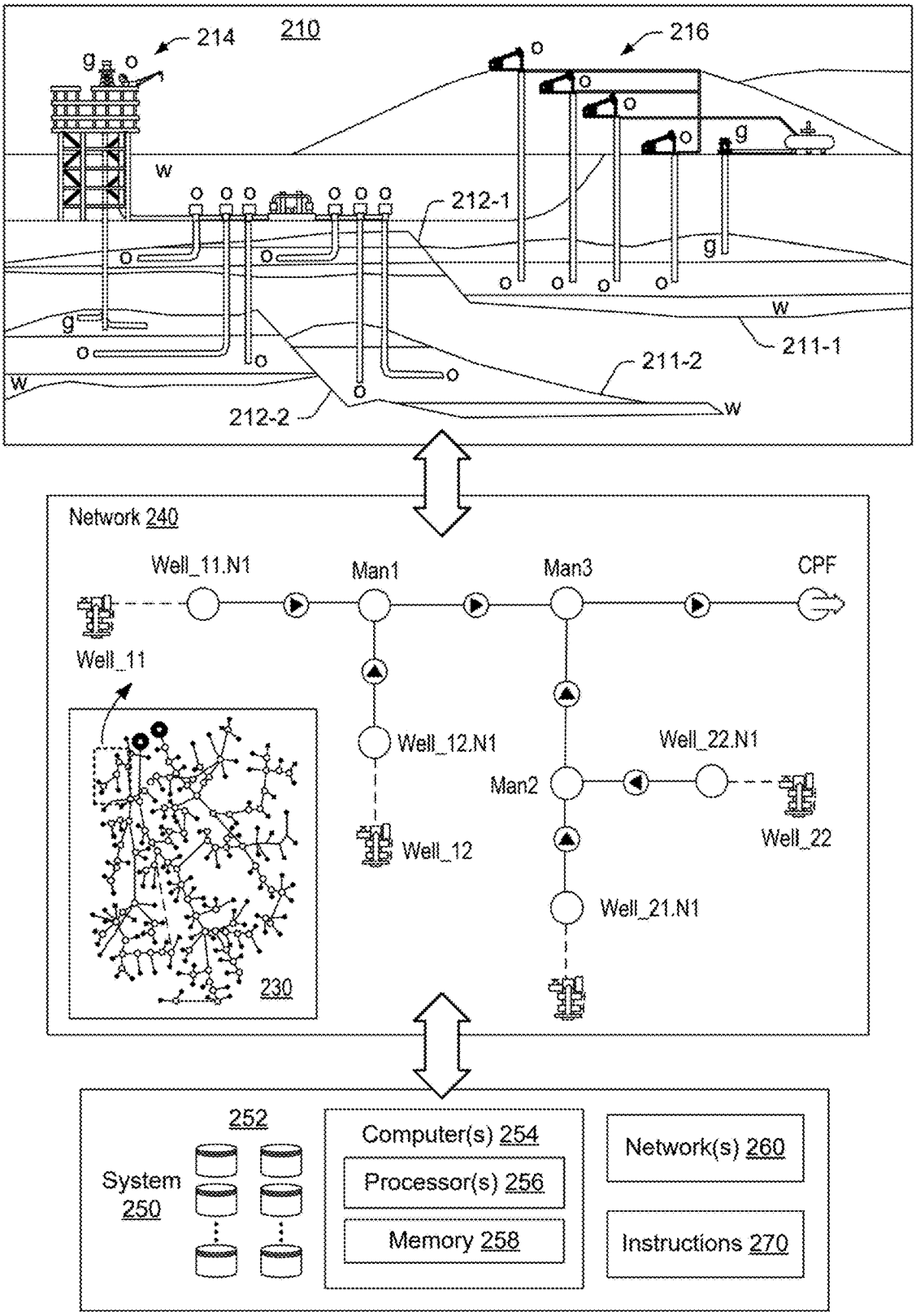
FIG. 2 illustrates examples of systems.

FIG. 2 shows an example of a geologic environment 210 that includes reservoirs 211-1 and 211-2, which may be faulted by faults 212-1 and 212-2, an example of a network of equipment 230, an enlarged view of a portion of the network of equipment 230, referred to as network 240, and an example of a system 250. FIG. 2 shows some examples of offshore equipment 214 for oil and gas operations related to the reservoir 211-2 and onshore equipment 216 for oil and gas operations related to the reservoir 211-1.

In the example of FIG. 2, the various equipment 214 and 216 may include drilling equipment, wireline equipment, production equipment, etc. For example, consider the equipment 214 as including a drilling rig that may drill into a formation to reach a reservoir target where a well may be completed for production of hydrocarbons. In such an example, one or more features of the system 100 of FIG. 1 may be utilized. For example, consider utilizing the DRILLPLAN framework to plan, execute, etc., one or more drilling operations.

In FIG. 2, the network 240 may be an example of a relatively small production system network. As shown, the network 240 forms somewhat of a tree like structure where flowlines represent branches (e.g., segments) and junctions represent nodes. As shown in FIG. 2, the network 240 provides for transportation of oil and gas fluids from well locations along flowlines interconnected at junctions with final delivery at a central processing facility.

In the example of FIG. 2, various portions of the network 240 may include conduit. For example, consider a perspective view of a geologic environment that includes two conduits which may be a conduit to Man1 and a conduit to Man3 in the network 240.

As shown in FIG. 2, the example system 250 includes one or more information storage devices 252, one or more computers 254, one or more networks 260 and instructions 270 (e.g., organized as one or more sets of instructions). As to the one or more computers 254, each computer may include one or more processors (e.g., or processing cores) 256 and memory 258 for storing the instructions 270 (e.g., one or more sets of instructions), for example, executable by at least one of the one or more processors. As an example, a computer may include one or more network interfaces (e.g., wired or wireless), one or more graphics cards, a display interface (e.g., wired or wireless), etc. As an example, imagery such as surface imagery (e.g., satellite, geological, geophysical, etc.) may be stored, processed, communicated, etc. As an example, data may include SAR data, GPS data, etc. and may be stored, for example, in one or more of the storage devices 252. As an example, information that may be stored in one or more of the storage devices 252 may include information about equipment, location of equipment, orientation of equipment, fluid characteristics, etc.

As an example, the instructions 270 may include instructions (e.g., stored in the memory 258) executable by at least one of the one or more processors 256 to instruct the system 250 to perform various actions. As an example, the system 250 may be configured such that the instructions 270 provide for establishing a framework, for example, that may perform network modeling (see, e.g., the PIPESIM framework of the example of FIG. 1, etc.). As an example, one or more methods, techniques, etc. may be performed using one or more sets of instructions, which may be, for example, the instructions 270 of FIG. 2.

Figure 3:
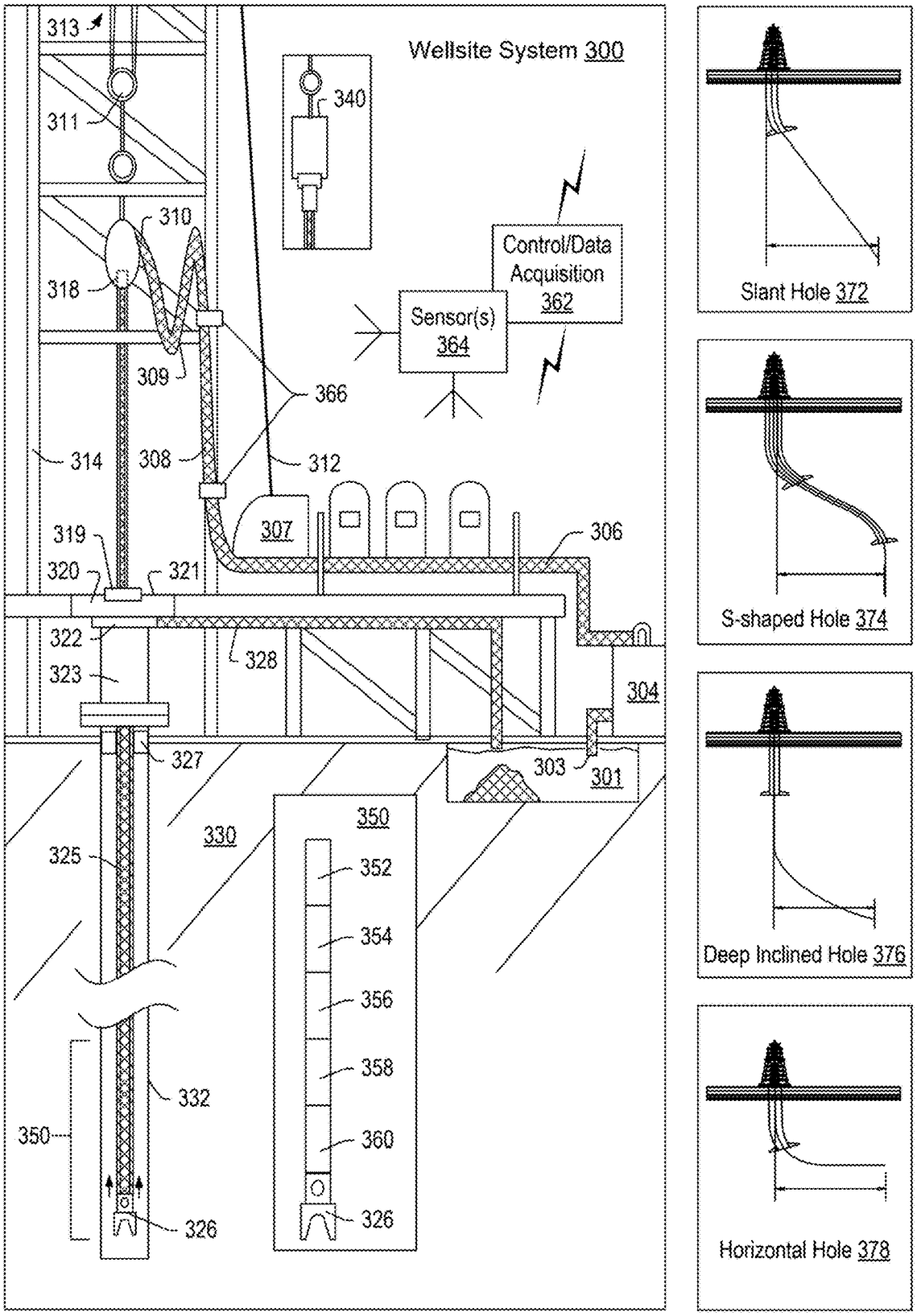
FIG. 3 illustrates an example of a system.

FIG. 3 shows an example of a wellsite system 300 (e.g., at a wellsite that may be onshore or offshore). As shown, the wellsite system 300 may include a mud tank 301 for holding mud and other material (e.g., where mud may be a drilling fluid), a suction line 303 that serves as an inlet to a mud pump 304 for pumping mud from the mud tank 301 such that mud flows to a vibrating hose 306, a drawworks 307 for winching drill line or drill lines 312, a standpipe 308 that receives mud from the vibrating hose 306, a kelly hose 309 that receives mud from the standpipe 308, a gooseneck or goosenecks 310, a traveling block 311, a crown block 313 for carrying the traveling block 311 via the drill line or drill lines 312, a derrick 314, a kelly 318 or a top drive 340, a kelly drive bushing 319, a rotary table 320, a drill floor 321, a bell nipple 322, one or more blowout preventors (BOPs) 323, a drillstring 325, a drill bit 326, a casing head 327 and a flow pipe 328 that carries mud and other material to, for example, the mud tank 301.

In the example system of FIG. 3, a borehole 332 is formed in subsurface formations 330 by rotary drilling; noting that various example embodiments may also use one or more directional drilling techniques, equipment, etc.

As shown in the example of FIG. 3, the drillstring 325 is suspended within the borehole 332 and has a drillstring assembly 350 that includes the drill bit 326 at its lower end. As an example, the drillstring assembly 350 may be a bottom hole assembly (BHA).

The wellsite system 300 may provide for operation of the drillstring 325 and other operations. As shown, the wellsite system 300 includes the traveling block 311 and the derrick 314 positioned over the borehole 332. As mentioned, the wellsite system 300 may include the rotary table 320 where the drillstring 325 pass through an opening in the rotary table 320.

As shown in the example of FIG. 3, the wellsite system 300 may include the kelly 318 and associated components, etc., or the top drive 340 and associated components. As to a kelly example, the kelly 318 may be a square or hexagonal metal/alloy bar with a hole drilled therein that serves as a mud flow path. The kelly 318 may be used to transmit rotary motion from the rotary table 320 via the kelly drive bushing 319 to the drillstring 325, while allowing the drillstring 325 to be lowered or raised during rotation. The kelly 318 may pass through the kelly drive bushing 319, which may be driven by the rotary table 320. As an example, the rotary table 320 may include a master bushing that operatively couples to the kelly drive bushing 319 such that rotation of the rotary table 320 may turn the kelly drive bushing 319 and hence the kelly 318. The kelly drive bushing 319 may include an inside profile matching an outside profile (e.g., square, hexagonal, etc.) of the kelly 318; however, with slightly larger dimensions so that the kelly 318 may freely move up and down inside the kelly drive bushing 319.

As to a top drive example, the top drive 340 may provide functions performed by a kelly and a rotary table. The top drive 340 may turn the drillstring 325. As an example, the top drive 340 may include one or more motors (e.g., electric and/or hydraulic) connected with appropriate gearing to a short section of pipe called a quill, that in turn may be screwed into a saver sub or the drillstring 325 itself. The top drive 340 may be suspended from the traveling block 311, so the rotary mechanism is free to travel up and down the derrick 314. As an example, a top drive 340 may allow for drilling to be performed with more joint stands than a kelly/rotary table approach.

In the example of FIG. 3, the mud tank 301 may hold mud, which may be one or more types of drilling fluids. As an example, a wellbore may be drilled to produce fluid, inject fluid or both (e.g., hydrocarbons, minerals, water, etc.).

In the example of FIG. 3, the drillstring 325 (e.g., including one or more downhole tools) may be composed of a series of pipes threadably connected together to form a long tube with the drill bit 326 at the lower end thereof. As the drillstring 325 is advanced into a wellbore for drilling, at some point in time prior to or coincident with drilling, the mud may be pumped by the pump 304 from the mud tank 301 (e.g., or other source) via the lines 306, 308 and 309 to a port of the kelly 318 or, for example, to a port of the top drive 340. The mud may then flow via a passage (e.g., or passages) in the drillstring 325 and out of ports located on the drill bit 326 (see, e.g., a directional arrow). As the mud exits the drillstring 325 via ports in the drill bit 326, it may then circulate upwardly through an annular region between an outer surface(s) of the drillstring 325 and surrounding wall(s) (e.g., open borehole, casing, etc.), as indicated by directional arrows. In such a manner, the mud lubricates the drill bit 326 and carries heat energy (e.g., frictional or other energy) and formation cuttings to the surface where the mud (e.g., and cuttings) may be returned to the mud tank 301, for example, for recirculation (e.g., with processing to remove cuttings, etc.).

The mud pumped by the pump 304 into the drillstring 325 may, after exiting the drillstring 325, form a mudcake that lines the wellbore which, among other functions, may reduce friction between the drillstring 325 and surrounding wall(s) (e.g., borehole, casing, etc.). A reduction in friction may facilitate advancing or retracting the drillstring 325. During a drilling operation, the entire drillstring 325 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 326 of the drillstring 325 at a bottom of a wellbore, pumping of the mud commences to lubricate the drill bit 326 for purposes of drilling to enlarge the wellbore. As mentioned, the mud may be pumped by the pump 304 into a passage of the drillstring 325 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may be modulated. In such an example, information from downhole equipment (e.g., one or more modules of the drillstring 325) may be transmitted uphole to an uphole device, which may relay such information to other equipment for processing, control, etc.

As an example, telemetry equipment may operate via transmission of energy via the drillstring 325 itself. For example, consider a signal generator that imparts coded energy signals to the drillstring 325 and repeaters that may receive such energy and repeat it to further transmit the coded energy signals (e.g., information, etc.).

As an example, the drillstring 325 may be fitted with telemetry equipment 352 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such an example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 3, an uphole control and/or data acquisition system 362 may include circuitry to sense pressure pulses generated by telemetry equipment 352 and, for example, communicate sensed pressure pulses or information derived therefrom for process, control, etc.

The assembly 350 of the illustrated example includes a logging-while-drilling (LWD) module 354, a measurement-while-drilling (MWD) module 356, an optional module 358, a rotary-steerable system (RSS) and/or motor 360, and the drill bit 326. Such components or modules may be referred to as tools where a drillstring may include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface. In such an example, a bit RPM may be determined or estimated based on the RPM of the mud motor.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 354 may be housed in a suitable type of drill collar and may contain one or a plurality of selected types of logging tools. It will also be understood that more than one LWD and/or MWD module may be employed. Where the position of an LWD module is mentioned, as an example, it may refer to a module at the position of the LWD module 354, the MWD module 356, etc. An LWD module may include capabilities for measuring, processing, and storing information, as well as for communicating with the surface equipment. In the illustrated example, the LWD module 354 may include a seismic measuring device.

The MWD module 356 may be housed in a suitable type of drill collar and may contain one or more devices for measuring characteristics of the drillstring 325 and the drill bit 326. As an example, the MWD module 356 may include equipment for generating electrical power, for example, to power various components of the drillstring 325. As an example, the MWD module 356 may include the telemetry equipment 352, for example, where the turbine impeller may generate power by flow of the mud; it being understood that other power and/or battery systems may be employed for purposes of powering various components. As an example, the MWD module 356 may include one or more of the following types of measuring devices: a weight-on-bit measuring device, a torque measuring device, a vibration measuring device, a shock measuring device, a stick slip measuring device, a direction measuring device, and an inclination measuring device.

FIG. 3 also shows some examples of types of holes that may be drilled. For example, consider a slant hole 372, an S-shaped hole 374, a deep inclined hole 376 and a horizontal hole 378.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and include equipment to perform method such as geosteering. As mentioned, a steerable system may be or include an RSS. As an example, a steerable system may include a PDM or a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 3, the wellsite system 300 may include one or more sensors 364 that are operatively coupled to the control and/or data acquisition system 362. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 300. As an example, a sensor or sensor may be at an offset wellsite where the wellsite system 300 and the offset wellsite are in a common field (e.g., oil and/or gas field).

As an example, one or more of the sensors 364 may be provided for tracking pipe, tracking movement of at least a portion of a drillstring, etc.

As an example, the system 300 may include one or more sensors 366 that may sense and/or transmit signals to a fluid conduit such as a drilling fluid conduit (e.g., a drilling mud conduit). For example, in the system 300, the one or more sensors 366 may be operatively coupled to portions of the standpipe 308 through which mud flows. As an example, a downhole tool may generate pulses that may travel through the mud and be sensed by one or more of the one or more sensors 366. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 300 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that cannot be rotated or moved axially. As an example, a condition referred to as "differential sticking" may be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

Figure 4:
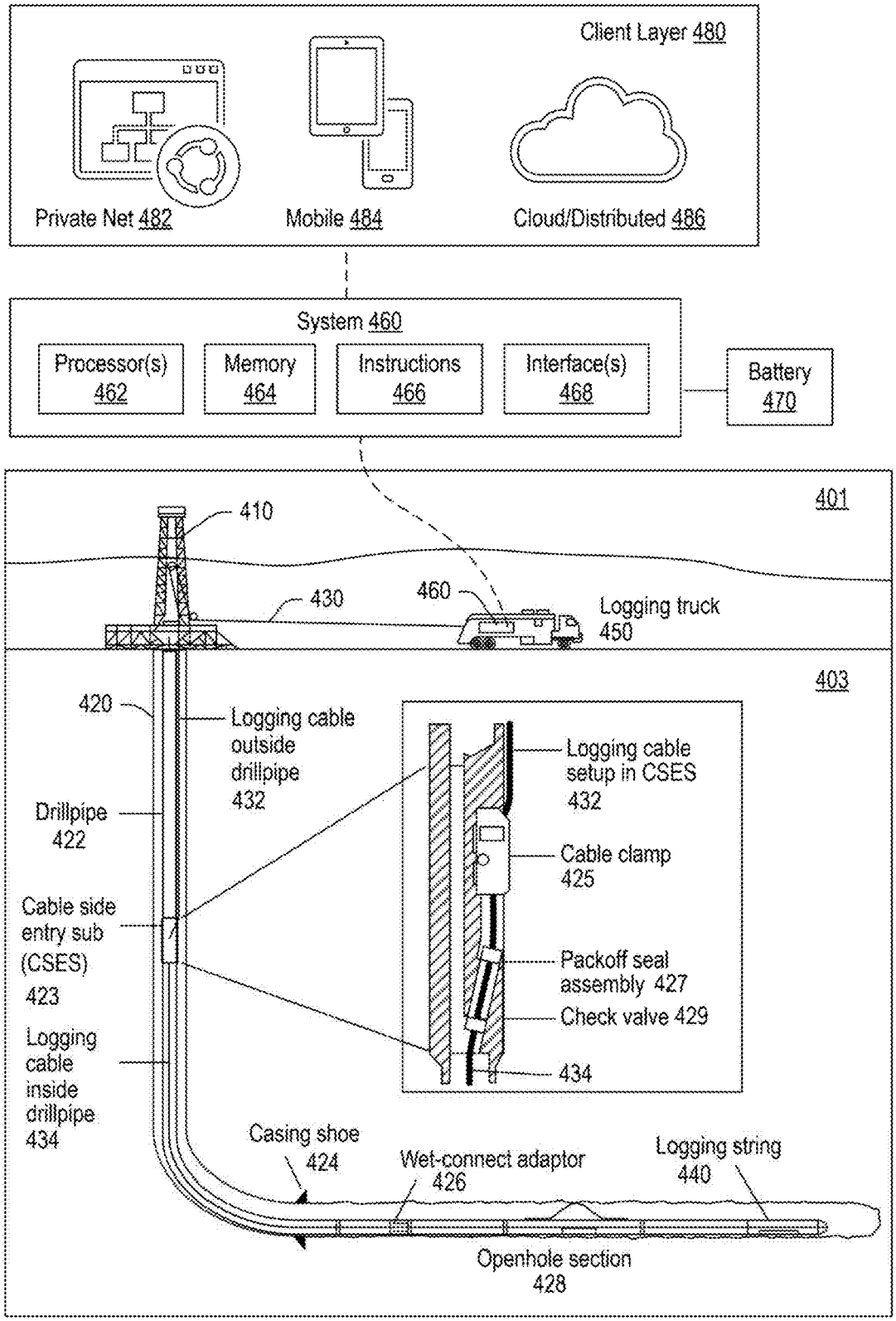
FIG. 4 illustrates an example of a system.

FIG. 4 shows an example of an environment 401 that includes a subterranean portion 403 where a rig 410 is positioned at a surface location above a bore 420. In the example of FIG. 4, various wirelines services equipment may be operated to perform one or more wirelines services including, for example, acquisition of data from one or more positions within the bore 420.

As an example, a wireline tool and/or a wireline service may provide for acquisition of data, analysis of data, data-based determinations, data-based decision making, etc. Some examples of wireline data may include gamma ray (GR), spontaneous potential (SP), caliper (CALI), shallow resistivity (LLS and ILD), deep resistivity (LLD and ILD), density (RHOB), neutron porosity (BPHI or TNPH or NPHI), sonic (DT), photoelectric (PEF), permittivity and conductivity. As an example, one or more tools may be suitable for use on a wireline and/or on a drillstring.

In the example of FIG. 4, the bore 420 includes drillpipe 422, a casing shoe 424, a cable side entry sub (CSES) 423, a wet-connector adaptor 426 and an openhole section 428. As an example, the bore 420 may be a vertical bore or a deviated bore where one or more portions of the bore may be vertical and one or more portions of the bore may be deviated, including substantially horizontal.

In the example of FIG. 4, the CSES 423 includes a cable clamp 425, a packoff seal assembly 427 and a check valve 429. These components may provide for insertion of a logging cable 430 that includes a portion 432 that runs outside the drillpipe 422 to be inserted into the drillpipe 422 such that at least a portion 434 of the logging cable runs inside the drillpipe 422. In the example of FIG. 4, the logging cable 430 runs past the casing shoe 424 and the wet-connect adaptor 426 and into the openhole section 428 to a logging string 440.

As shown in the example of FIG. 4, a logging truck 450 (e.g., a wirelines services vehicle) may deploy the logging cable 430 (e.g., wireline) under control of a system 460. As shown in the example of FIG. 4, the system 460 may include one or more processors 462, memory 464 operatively coupled to at least one of the one or more processors 462, instructions 466 that may be, for example, stored in the memory 464, and one or more interfaces 468. As an example, the system 460 may include one or more processor-readable media that include processor-executable instructions executable by at least one of the one or more processors 462 to cause the system 460 to control one or more aspects of equipment of the logging string 440 and/or the logging truck 450. In such an example, the memory 464 may be or include the one or more processor-readable media where the processor-executable instructions may be or include instructions. As an example, a processor-readable medium may be a computer-readable storage medium that is not a signal and that is not a carrier wave.

FIG. 4 also shows a battery 470 that may be operatively coupled to the system 460, for example, to power the system 460. As an example, the battery 470 may be a back-up battery that operates when another power supply is unavailable for powering the system 460 (e.g., via a generator of the wirelines truck 450, a separate generator, a power line, etc.). As an example, the battery 470 may be operatively coupled to a network, which may be a cloud network. As an example, the battery 470 may include smart battery circuitry and may be operatively coupled to one or more pieces of equipment via a SMBus or other type of bus.

As an example, the system 460 may be operatively coupled to a client layer 480. In the example of FIG. 4, the client layer 480 may include features that allow for access and interactions via one or more private networks 482, one or more mobile platforms and/or mobile networks 484 and via the "cloud" 486, which may be considered to include distributed equipment that forms a network such as a network of networks. As an example, the system 460 may include circuitry to establish a plurality of connections (e.g., sessions). As an example, connections may be via one or more types of networks. As an example, connections may be client-server types of connections where the system 460 operates as a server in a client-server architecture. For example, clients may log-in to the system 460 where multiple clients may be handled, optionally simultaneously.

While the example of FIG. 4 shows the system 460 as being associated with the logging truck 450, one or more features of the system 460 may be included in a downhole assembly, which may be a wireline assembly and/or a LWD assembly. In such an approach, various computations may be performed downhole where results thereof may be optionally transmitted to surface (e.g., to the logging truck 450, etc.) using one or more telemetric technologies and/or techniques (e.g., mud-pulse telemetry, wireline, etc.).

As an example, a framework may provide for pore system characterization of carbonate formations, for example, using a multiphysics approach that includes data acquired via a sonic tool and data acquired via an NMR tool, which may be present on a common tool string, separate tool strings, etc. As an example, such data may be acquired using a drillstring and/or using a wireline string.

Pore system characterization and thus permeability estimation in carbonate rocks may present challenges due to complexity of carbonate rocks. As an example, a framework may compute volume fractions of crack pores (e.g., micro cracks and micro fractures with a low aspect ratio), reference pores (e.g., interparticle pores with a medium aspect ratio) and stiff pores (e.g., moldic and vuggy pores with an aspect ratio close to one) through the inversion of an effective medium rock physics (EMRP) model using acoustic compressional and shear measurements as acquired by a sonic tool (e.g., a downhole sonic logging tool). In such an example, micro and macro porosities may be inferred from NMR data that may be interpreted to determine volume fractions of a number of pore groups. For example, consider six pore groups: micro crack, micro reference, micro stiff, macro crack, macro reference, macro stiff. In such an example, sonic data and NMR data may be processed using a joint inversion, which may be a simultaneous joint inversion. As an example, a framework may include computing a semi-long axis (I), a semi-short axis (s) and cross section area index (rs) for a number of pore groups through aspect ratios from sonic measurement and pore surface area to volume ratio for micro pores and macro pores from NMR measurements. As an example, derived pore geometry parameters may be used along with total porosity to build an empirical model for permeability estimation based on calibration with core data.

Elastic effective medium theory (EMT) relates to quantitative rock physics modeling that can, for example, compute macroscopic properties of a mixture by incorporating the individual elastic properties, the volume fractions, and the spatial arrangement of the constituents that make up the rock. As an example, one or more types of effective medium rock physics models may be utilized. For example, consider an article by Ojala (Ojala, Ira. (2009). Using rock physics for constructing synthetic sonic logs, Proceedings of the 3rd CANUS Rock Mechanics Symposium, Toronto, May 2009 (Ed: M.Diederichs and G.Grasselli)), which is incorporated by reference herein. A basic model may consider velocity and porosity (d)) where velocities may include velocity in fluid saturated rock (Vp), velocity in pore fluid (Vpf) and velocity in minerals that make up the rock (Vpr):

$$1/Vp=\phi/Vpf+(1-\phi)/Vpr$$

The foregoing model is empirical and assumes a homogenous mineralogy. As explained, one or more models may be utilized, which may be more detailed and/or theoretically based. For example, consider Holt & Fjaer (Wave velocities in shales—a rock physics model. EAGE 65th Conference and Exhibition, Stavanger, Norway, 2-5 Jun. 2003), which accounts for bulk and shear moduli of effective pore water along with bound fraction of water. A US Patent Application publication having Publication No. US 20170371072 A1, which is incorporated by reference herein, describes various effective medium rock physics models. As explained, in the '072 application, with regard to computing the compressional wave velocity parameter Vp(ri) and the shear wave velocity parameter Vs(r1), an effective medium rock physics model may be used for formations with complex mineralogy that are composed of multiple minerals and pore types (e.g., such as shaly sandstones or carbonates); noting, by way of example, a Xu-White effective medium rock physics model may be used to compute the radial profiles of compressional wave velocity Vp(ri) and shear wave velocity Vs(ri) and that one or more alternate or additional models could be applied (e.g., Self-Consistent model and the Xu-Payne model).

An integrated pore characterization method may be implemented using log data that includes sonic log data and NMR log data, which may be acquired in real-time, separately at different times, etc. In various trials applied to field data, such a method demonstrated results for carbonate pore system characterization. Where six pore groups were utilized, total porosity was readily partitioned into the six pore types with corresponding pore body size information of long axis and short axis. Comparisons with interpretations based on borehole images and core analysis demonstrate consistent results. In various examples, subsequent permeability estimates based on derived pore geometry parameters improved the permeability evaluation compared to existing methods, demonstrating that integration of NMR and sonic data enhances understanding of rock productivity and reservoir characterization, particularly with respect to permeability in carbonate formations, which may be relevant in hydrocarbon production.

As explained, through integration of NMR and sonic measurements, carbonate pore characterization may be improved by defining groups of sub-pores, together with pore body size information for each pore type. In addition, carbonate rock permeability estimation may be improved, for example, by introducing a cross sectional area index, by integrating pore surface area to volume ratio from NMR measurement and aspect ratio from sonic measurements. Such a method leads to improved formation evaluation and reservoir characterization in carbonate reservoirs.

Figure 5:
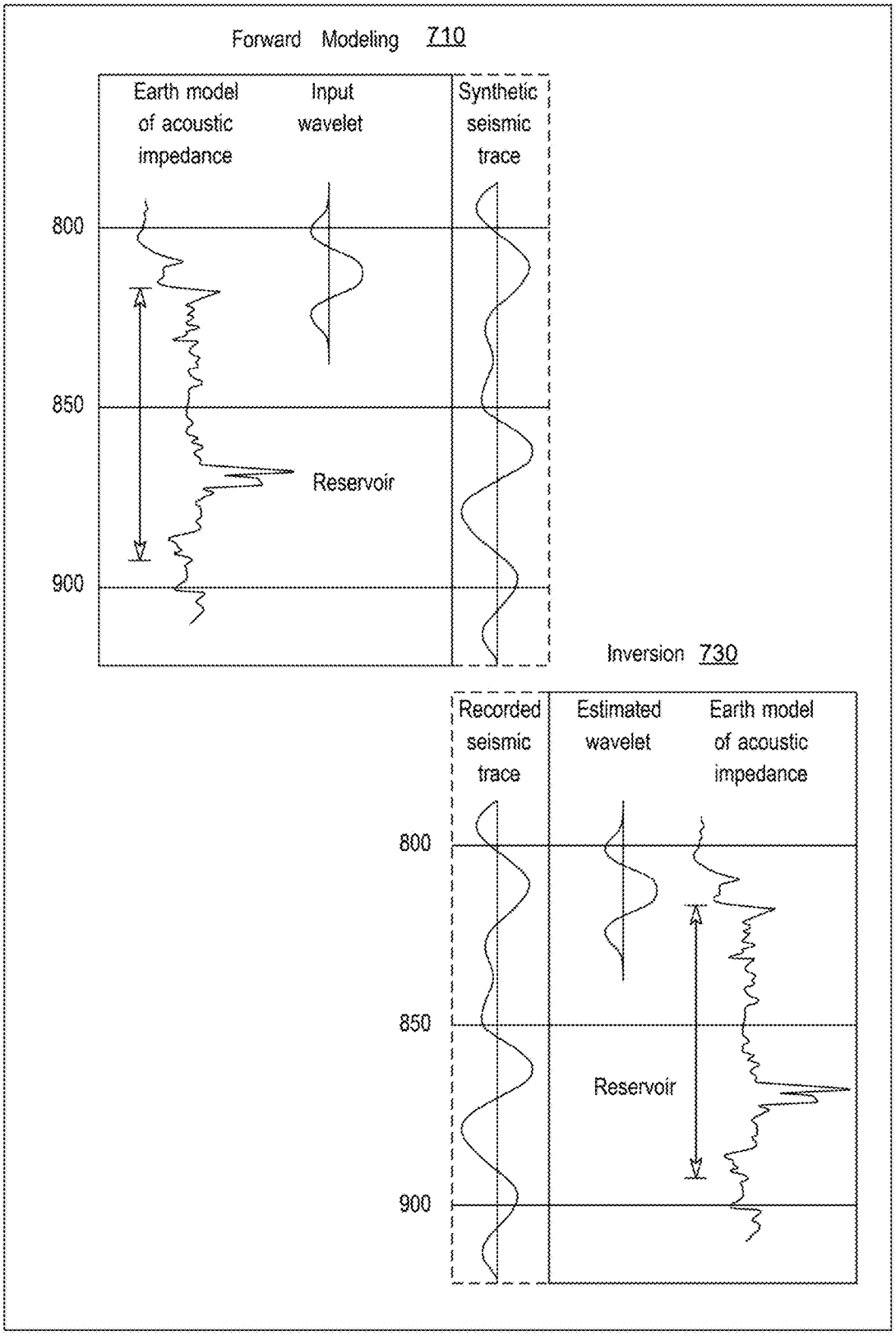
FIG. 5 illustrates an example of a forward modeling and an example of inversion.

FIG. 5 shows an example of forward modeling 710 and an example of inversion 730 (e.g., an inversion or inverting) with respect to seismic data to demonstrate the concept of model-based inversion. As shown, the forward modeling 710 progresses from an earth model of acoustic impedance and an input wavelet to a synthetic seismic trace while the inversion 730 progresses from a recorded seismic trace to an estimated wavelet and an Earth model of acoustic impedance. As an example, forward modeling may take a model of formation properties (e.g., acoustic impedance as may be available from well logs) and combine such information with a seismic wavelength (e.g., a pulse) to output one or more synthetic seismic traces while inversion may commence with a recorded seismic trace, account for effect(s) of an estimated wavelet (e.g., a pulse) to generate values of acoustic impedance for a series of points in time (e.g., depth).

In the example of FIG. 5, acoustic impedance is the opposition of a medium to a longitudinal wave motion. Acoustic impedance is a physical property whose change determines reflection coefficients at normal incidence, that is, seismic P-wave velocity multiplied by density. Acoustic impedance characterizes the relationship between the acting sound pressure and the resulting particle velocity.

During the propagation of seismic wave along a ray path, a seismic wave transmits through or reflects at a material boundary and/or converts its vibration mode between P-wave and S-wave. An observed amplitude of a seismic wave depends on an acoustic impedance contrast at a material boundary between an upper medium and a lower medium. Acoustic impedance (Z) may be defined by a multiplication of density (p) and seismic velocity (Vp) in each media. Acoustic impedance Z tends to be proportional to Vp for the many sedimentary and crustal rocks (e.g., granite, anorthite, pyrophyllite, and quartzite), except for some ultramafic rocks (e.g., dunite, eclogite, and peridotite) in the mantle.

As to sonic data, it may differ from seismic data such as seismic survey data. As an example, sonic data may include data for formation compressional slowness, for example, based on the transit time between transmitter(s) and receiver(s) positioned in a borehole (e.g., the same borehole). As an example, a wireline sonic measurement may be acquired using an acoustic transducer that emits a sonic signal (e.g., consider a signal within a range of approximately 10 kHz and 30 kHz) that may be detected at two receivers (e.g., farther up the hole). In such an example, the time between emission and reception may be measured for each receiver, and subtracted to give the traveltime in the interval between the two receivers. If the receivers are two distance units apart, then this time is divided by two to give the interval transit time, or slowness, of the formation (e.g., in units of time over distance). In such an approach, the first arrival at the receiver is a wave that has traveled from the transmitter to the borehole wall, where it has generated a compressional wave in the formation. Some of this wave is critically refracted up the borehole wall, generating head waves in the borehole fluid as it progresses. Some of these strike the receiver, arriving in most instances ahead of other signals traveling directly through the mud. Where a logging tool is parallel to a borehole wall, the traveltime in the mud may be cancelled by taking the difference between the traveltime to the two receivers. An irregular hole or a tilted tool may be handled using borehole compensation. As to depth of investigation (DOI), it may depend on the slowness, the transmitter-to-receiver spacing and the presence or absence of an altered zone. DOI may be within an invaded zone and, for example, be of the order of centimeters (e.g., consider up to approximately 10 cm). For sonic measurements such as shear, flexural and Stoneley slownesses and amplitudes, a full waveform may be recorded, for example, using an array-sonic tool and process with a technique such as slowness-time coherence. As an example, one or more sonic measurements may be in the form of a log, which may be referred to as a sonic log. A sonic log may display traveltime of P-waves versus depth. A sonic log or sonic logs may be recorded by movement of a tool (e.g., LWD, wireline, etc.) in a bore where, as explained, the tool emits a sound wave or sound waves that travel to a formation and back to a receiver or receivers.

The frequencies for a sonic tool may be higher than those utilized for seismic surveys. A higher frequency may provide for greater resolution, though, with lesser penetration (e.g., greater attenuation of energy). For example, a marine equipment seismic survey may utilize frequencies between approximately 8 Hz and approximately 80 Hz and broadband marine seismic survey systems may utilize frequencies from approximately 2.5 Hz up to approximately 200 Hz. On land, a vibrator (e.g., a truck, etc.) may produce signal frequencies down to approximately 1.5 Hz. Sonic waves in a borehole at 10 kHz propagating in a 5,000 m/s formation have a wavelength of approximately 0.5 m; whereas, seismic survey wavelengths may measure in the tens of meters.

As explained, a sonic log may be acquired by wireline tools (e.g., dipole sonic tool, etc.) and/or LWD tools (e.g., consider the SONIC SCANNER tool, Schlumberger Limited, Houston, Texas) that utilize frequencies that are greater than the frequencies of a seismic survey. As such a sonic log may be of a greater resolution as to a vertical and/or a measured depth (e.g., as a sonic log is a borehole log) when compared to a seismic survey.

Figure 6:
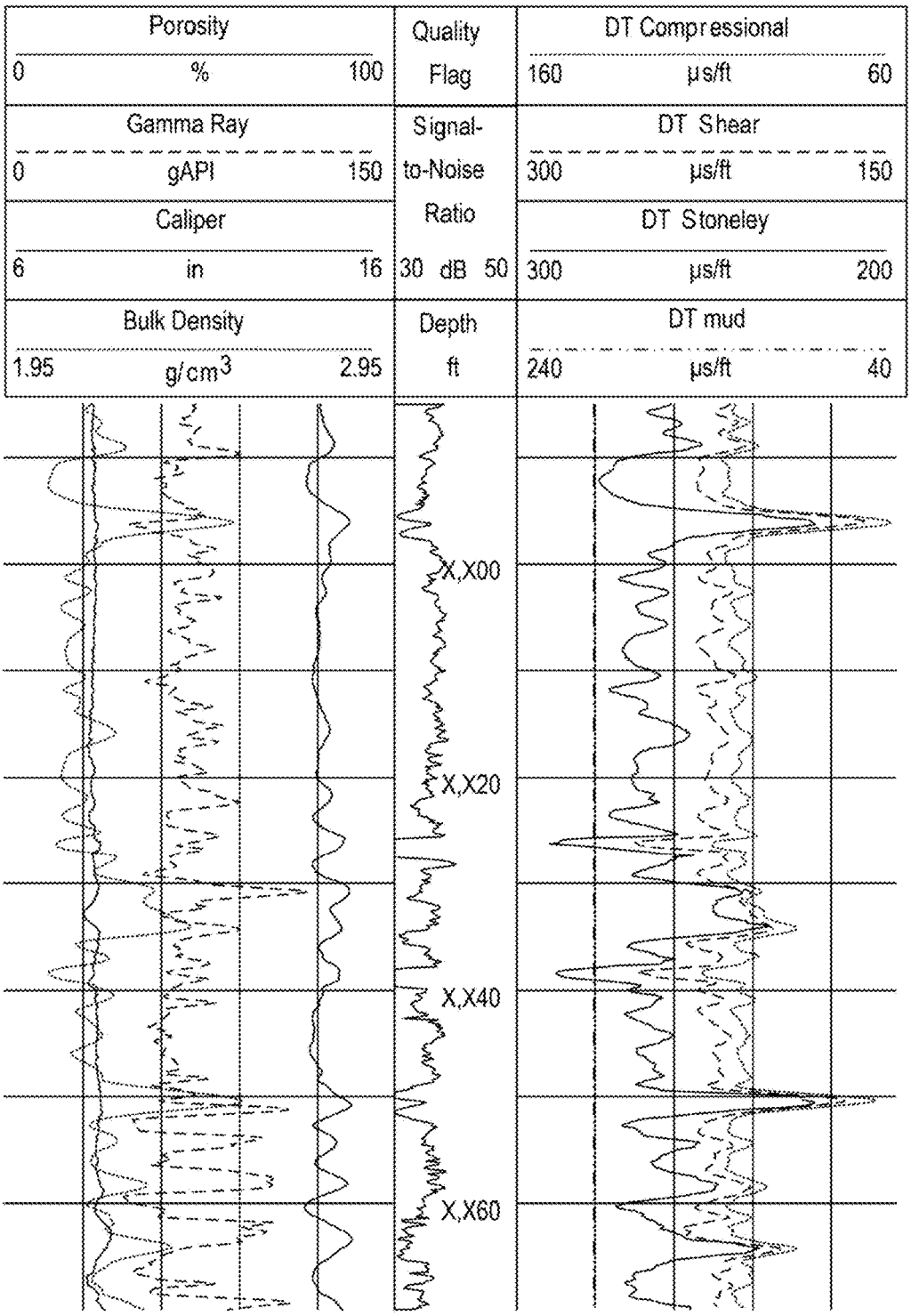
FIG. 6 illustrates examples of logs.

FIG. 6 shows an example plot 600 of various logs as acquired by a tool such as the SONIC SCANNER tool. In a left hand column, porosity in percent, gamma ray in gAPI, caliper in inches, and bulk density in grams per cubic centimeter are shown with respect to depth in feet. In a right hand column, compressional wave slowness, shear wave slowness, Stoneley wave slowness and mud slowness are shown, each in units of microseconds per foot (e.g., note that the scales are from a greater slowness to a lesser slowness in moving from left to right). The sonic slowness data in the plot 600 show variations with respect to depth over a range of approximately 80 feet.

As an example, a method may include building a velocity model by using one or more sonic logs that are upscaled and/or blocked to lead to a 1D velocity model representing a zone of interest and its surroundings. In such an approach, an initial velocity model may be subsequently calibrated using one or more of various types of seismic-scale inversion algorithms. As an example, a collection of 3D velocity models incorporating the structural component of a zone of interest may be prepared using one or more 1D velocity models.

As an example, an NMR unit may be sensitive to a volume of approximately 1 cm to approximately 3 cm or more into a formation where the volume may extend a length of an antenna along a longitudinal axis of the NMR unit (e.g., 5 cm to 15 cm or more), which may be a factor in vertical resolution. As an example, an antenna may be operated as a transmitter, a receiver or both a transmitter and a receiver. As a transmitter, an antenna may transmit a sequence for an oscillating magnetic field (e.g., consider a CPMG pulse sequence, etc.). As a receiver, an antenna may receive pulse echoes from a formation, including substances in the formation such as one or more fluids.

NMR may be used for reservoir characterization due to its capability of measuring the hydrogen nuclei in fluid. As both water and hydrocarbons like oil and gas contain hydrogen nuclei, they may be measured and quantified by NMR tools. Furthermore, NMR measurement of sample properties, such as relaxation times (T1 and T2 or $T_1$ and $T_2$) and diffusion coefficients enable understanding of the dynamics of fluids, resulting in the interpretation of their physical state (e.g., free or bound), the sizes of the pores they are confined in, the viscosity and type of hydrocarbons, and the permeability, and other properties of the rock system.

NMR relaxation such as measured by T2 has been shown to be directly proportional to the surface-to-volume ratio of a porous material. Surface relaxivity is a quantity (in units of micron/second) that defines the strength of the surface relaxation phenomenon. Because of this relationship, NMR may be used in petroleum exploration to obtain estimates of porosity, pore size, bound fluids, permeability, and other rock and fluid properties (e.g., "petrophysical data"). For example, it is known that a T2 distribution is closely related to the pore size distribution. Reservoir rocks often exhibit a wide range of T2s due to the difference in pore sizes, with observed T2 from several seconds down to tens of microseconds. Signals at long T2 (e.g., greater than 100 milliseconds) tend to be from large pores and such fluids may be considered producible. For shorter T2 signals (e.g., 3 milliseconds to 50 milliseconds), the fluids are often considered to be bound by capillary force of the pores. For example, fluids in sandstone rocks with T2 below 30 ms are considered bound by capillary force and tend not to produce. Thus, a cutoff value, T2 cut (e.g., T2 cut=30 ms) may be used to calculate the bound fluid volume.

Figure 7:
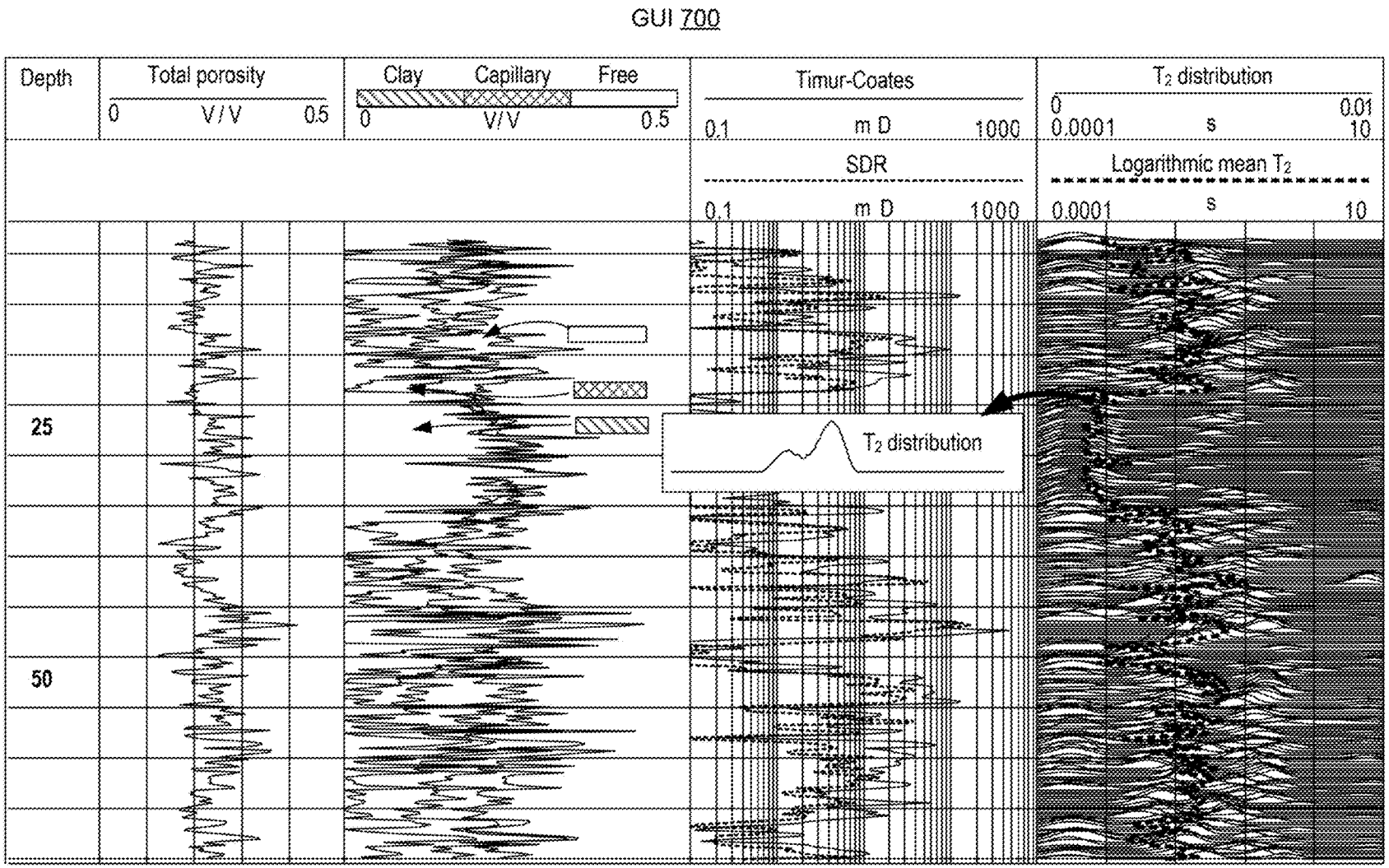
FIG. 7 illustrates examples of logs.

FIG. 7 shows an example of a graphical user interface (GUI) 700 that includes graphics derived from NMR data as acquired by an NMR unit of a downhole tool. The GUI 700 shows four tracks in log form, with respect to depth and various other scales. The GUI 700 may include, for example, a gamma ray track, which may help to provide indication of position (e.g., depth, measured depth, etc.). As shown, the first track includes a plot of total porosity (e.g., lithology-independent), the second track includes graphics of volumes of clay-bound water, capillary-bound water, and free fluid derived from a measured T2 distribution (see, e.g., T2), the third track includes permeability estimate graphics as derived using Timur-Coates and Schlumberger-Doll-Research (SDR) permeability equations and the fourth track includes the measured T2 distribution as well as the logarithmic mean T2 values at various depths.

Referring again to the GUI 700 and the fourth track, T2 distributions are illustrated graphically for a series of depths. The GUI 700 shows a single T2 distribution amplified to demonstrate that T2 values may have a peak or peaks for a volume of investigation at a particular depth. As an example, a higher vertical resolution may provide for more T2 distributions over a particular segment of a borehole. As an example, a sequence that may be executed in lesser time and/or lesser data transmission demands, with acceptable data quality, may provide for a greater measurement speed, which may allow for receiving data for a segment of a borehole in a shorter period of time (e.g., more rapid formation evaluation, etc.).

As an example, a method may include various parameters such as a speed parameter, a number of NMR measurements at different depths per unit time parameter, a sequence duration parameter, a maximum speed parameter as to NMR measurements, a maximum speed parameter as to physical constraints on a logging tool and/or a logging system, a maximum data rate or bit rate for transmission of data from a downhole tool, a maximum processing rate as to processing of data (e.g., downhole and/or uphole), etc.

As an example, a framework may integrate sonic measurements and NMR measurements to partition total porosity of carbonate rocks into a number of pore groups (e.g., consider micro crack, micro reference, micro stiff, macro crack, macro reference, macro stiff), which characterize pores in a relatively complete manner. As an example, a framework may provide for integrating pore aspect ratio (semi short axis over semi long axis) from sonic measurements and surface area to volume ratio from NMR measurements to determine pore size information (e.g., cross sectional area index, that is the product of semi short axis and semi long axis), which may then be used together with the volume fraction of pore groups to estimate permeability in carbonate rocks.

As an example, carbonate pore characterization may be improved by utilizing a number of groups of sub-porosities (e.g., micro crack, micro reference, micro stiff, macro crack, macro reference and macro stiff) where such groups may be discerned through the integration of NMR and sonic measurements. As an example, carbonate rock permeability estimation may be improved by introducing cross sectional area index, through integrating pore surface area to volume ratio from NMR measurement and aspect ratio from sonic measurements. Such an approach may improve formation evaluation and reservoir characterization in carbonate reservoirs, which may be found, for example, in the Middle East and elsewhere.

NMR T2 distribution may be used to partition the total porosity into classes by using cutoffs or by using a spectral analysis method such as NMR factor analysis, CIPHER, etc. Sonic compressional slowness and shear slowness may be used to partition the total porosity into crack (microcrack or fracture), reference (interparticle pores) and stiff (moldic pores, intraframe or vugs) classes, through effective medium rock physics models. As explained, a framework may provide for integrating NMR and sonic measurements to improve and/or cross-check individual classification and/or acquire more detailed porosity partitioning results.

NMR measurements may be used to estimate carbonate permeability, for example, consider the SDR carbonate equation:

$$k_{SDR} = \text{KSDR_MULT} \times \varphi^{KSDR_{PHI_{EXP}}} \times (\rho \times T_{2LM})^{KSDR_T2_EXP}$$

where:

$\varphi$ is the total porosity, $\rho$ is the surface relaxivity, $T_{2LM}$ is the logarithmic mean of the T2 distribution, KSDR_MULT is a multiplier for SDR permeability, KSDR_PHI_EXP is a porosity exponent for SDR permeability, and KSDR_T2_EXP is a T2 exponent for SDR permeability.

However, when bulk relaxation and diffusion effects are negligible in comparison with surface relaxation effect, NMR transverse relaxation time (T2) tends to reflect pore surface area to volume ratio rather than pore size, shape, and connectivity:

$$\frac{1}{T_2} = \rho_2 \times \left(\frac{S}{V}\right)$$

where:

$T_2$ is the relaxation time (s), and $\rho_2$ is the surface relaxivity (μ/s)

(e.g., 5 for sands and 1.7 for carbonates).

Thus, at times, estimating permeability through T2 (e.g., T2) directly may lead to inaccurate results.

Micro and macro pores from NMR measurements may be utilized to partition total porosity based on pore surface area to volume ratio, while crack, reference and stiff pores from sonic measurements may be utilized to partition the total porosity based on pore aspect ratio and/or one or more other suitable metrics that may characterize pore shape. The relationship between surface area to volume ratio and aspect ratio is a function that depends on pore shape and size. It may be challenging to consolidate pore partition by simply using these two measurements separately. As an example, a framework may integrate these two measurements and further partition the total porosity into a more detailed grouping, for example, using six groups (e.g., micro crack, micro reference, micro stiff, macro crack, macro reference and macro stiff).

Figure 8:
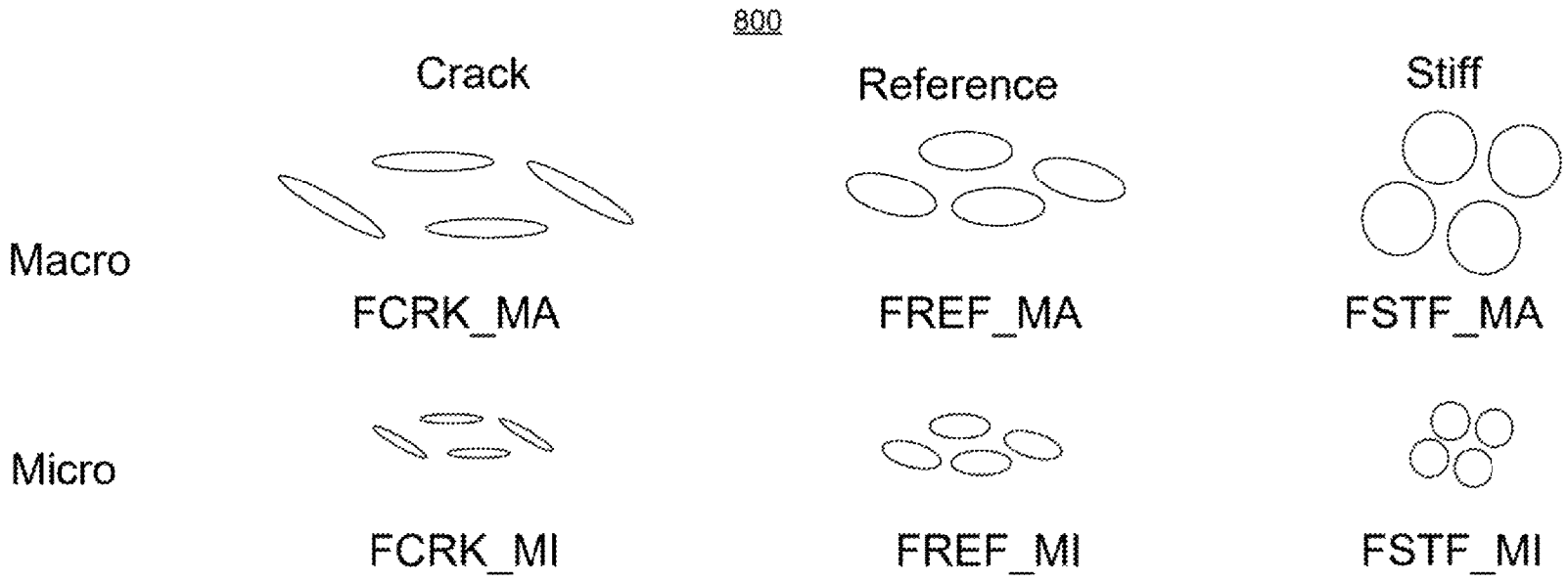
FIG. 8 illustrates examples of classes and examples of equations.

FIG. 8 shows an example graphic 800 along with sets of equations that may be utilized for grouping where each group may be considered a class. In the example of FIG. 8, there are six groups (e.g., six classes) and six equations. Specifically, in FIG. 8, PHI_MACRO and PHI_MICRO are macro porosity and micro porosity from NMR, while FCRK, FREF and FSTF are volume fractions of crack, reference and stiff pores from sonic measurement. In FIG. 8, "MA" is an abbreviation for macro and "MI" is an abbreviation for micro.

Figure 9:
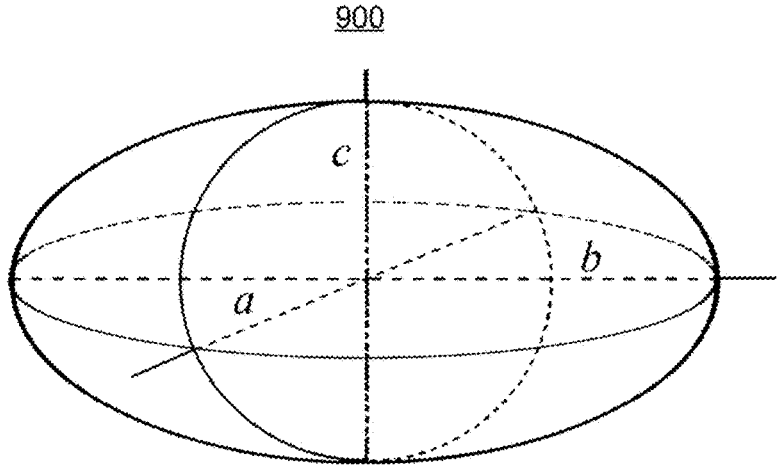
FIG. 9 illustrates an example of a geometric model and examples of equations.

FIG. 9 shows an example of a shape and associated equations 900 that may be utilized to characterize pores. As an example, an oblate shape may be utilized to characterize pore space and properties (e.g., semi long axis, semi short axis, aspect ratio, surface area to volume ratio).

In the example of FIG. 9, with aspect ratio from sonic measurements and surface area to volume ratio from NMR measurements, semi long axis (a) and semi short axis (c) may be computed using the equations. As shown, one of the equations pertains to the product (a*c), which is proportional to the cross section area of the pore space and defined as the cross section area index of the pore space. As the dimension of permeability is also related to area, cross section area index (a*c) may be a better permeability indicator than surface area to volume ratio.

As to shapes, consider an oblate spheroid (see, e.g., Weisstein, Eric W. "Oblate Spheroid." From MathWorld—A Wolfram Web Resource. https://mathworld.wolfram.com/OblateSpheroid.html, which is incorporated by reference herein), which may be defined as a "squashed" spheroid for which the equatorial radius a is greater than the polar radius c, so a>c (e.g., also referred to as an oblate ellipsoid). An oblate spheroid is a surface of revolution obtained by rotating an ellipse about its minor axis. To first approximation, the shape assumed by a rotating fluid (including the Earth, which is "fluid" over astronomical time scales) is an oblate spheroid.

Another type of shape is a prolate spheroid, which is a spheroid that is "pointy" instead of "squashed," (e.g., for which the polar radius c is greater than the equatorial radius a, so c>a (e.g., also referred to as a spindle-shaped ellipsoid). A symmetrical egg (e.g., with the same shape at both ends) would approximate a prolate spheroid. A prolate spheroid is a surface of revolution obtained by rotating an ellipse about its major axis (see, e.g., Weisstein, Eric W. "Prolate Spheroid." From MathWorld—A Wolfram Web Resource. https://mathworld.wolfram.com/ProlateSpheroid.html, which is incorporated by reference herein).

As an example, a cuboid may be utilized to characterize shape. A cuboid may be defined to be a box composed of three pairs of rectangular faces placed opposite each other and joined at right angles to each other, also known as a rectangular parallelepiped. The cuboid is also a right prism, a special case of the parallelepiped, and corresponds to what may be referred to as a rectangular box. As to a cuboid, the lengths of the sides may be denoted a, b, and c. A cuboid with sides equal (a=b=c) is called a cube, and a cuboid with integer edge lengths a>b>c and face diagonals is called an Euler brick. If a space diagonal is also an integer, the cuboid is called a perfect cuboid (see, e.g., Weisstein, Eric W. "Cuboid." From MathWorld—A Wolfram Web Resource. https://mathworld.wolfram.com/Cuboid.html, which is incorporated by reference herein).

As an example, a capsule may be utilized to characterize shape. A capsule is a term coined for a stadium of revolution, a cylinder with two hemispherical caps on either end (see, e.g., Weisstein, Eric W. "Capsule." From MathWorld—A Wolfram Web Resource. https://mathworld.wolfram.com/Capsule.html, and Weisstein, Eric W. "Stadium." From MathWorld—A Wolfram Web Resource. https://mathworld.wolfram.com/Stadium.html, which are incorporated by reference herein). As an example, a needle may be utilized to characterize shape. A needle may be akin to a capsule where an end or ends may be conical, ellipsoidal, etc. As an example, a shape may be cylindrical with a hemi-ellipsoidal cap on one or both ends (e.g., same or different). As an example, a shape may be composed of and/or may include two hemi-ellipsoids, two cones, etc. As an example, a shape may be symmetric or asymmetric.

Figure 10:
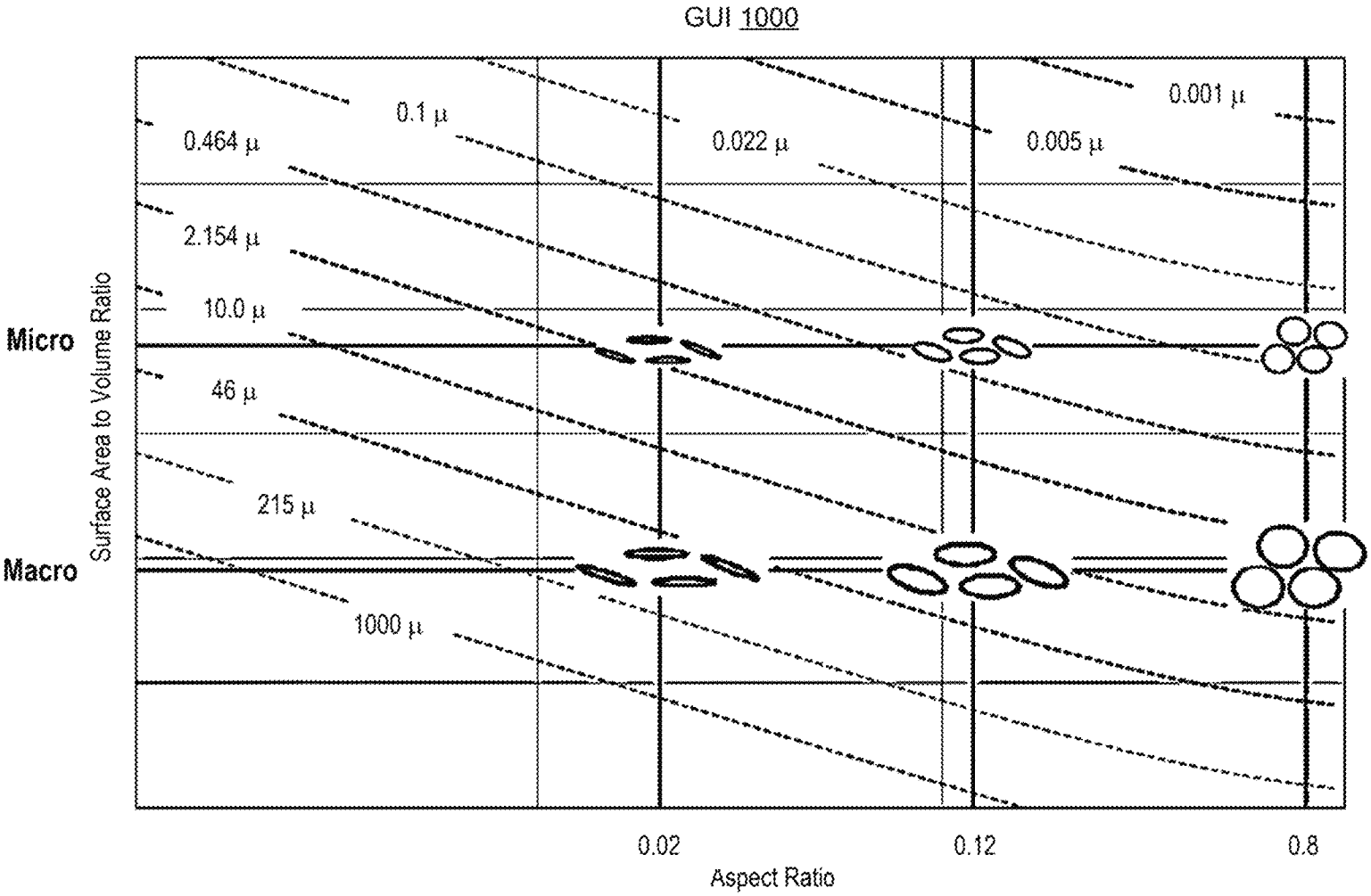
FIG. 10 illustrates an example of a graphical user interface.

FIG. 10 shows an example of a graphical user interface (GUI) 1000. As shown in the GUI 1000, using an oblate shape, acquiring a long semi axis (a) from aspect ratio and surface area to volume ratio for six pore groups (micro crack, micro reference, micro stiff, macro crack, macro reference, macro stiff) is illustrated where the X axis represents aspect ratio and the Y axis represents pore surface area to volume ratio in unit of 1/micron (μ), while dashed curves with different colors represent correlation between surface area to volume ratio and aspect ratio for specific semi long axis value. With aspect ratios for stiff pores, reference pores and crack pores from sonic measurement (indicated by three vertical black lines), and surface area to volume ratio for micro pores and macro pores from NMR measurement (indicated by two horizontal black lines), semi long axis for six pore groups may be determined, then semi short axis and cross section area index for six pore groups are acquired.

Again, in the GUI 1000 of FIG. 10, the X axis represents sonic measurement-based aspect ratio and the Y axis represents NMR measurement-based pore surface area to volume ratio in unit of reciprocal microns, while dashed curves with different colors represent correlation between surface area to volume ratio and aspect ratio for specific semi long axis value. With aspect ratios for stiff pores, reference pores and crack pores from sonic measurements (indicated by three vertical thick black lines), and surface area to volume ratio for micro pores and macro pores from NMR measurements (indicated by two horizontal thick black lines).

As an example, core permeability data may be used together with volume fractions and cross section area index of the example six pore groups in order to acquire regression coefficients, which may then be used to estimate permeability (e.g., for a particular well at other depths optionally without using core data).

Figure 11:
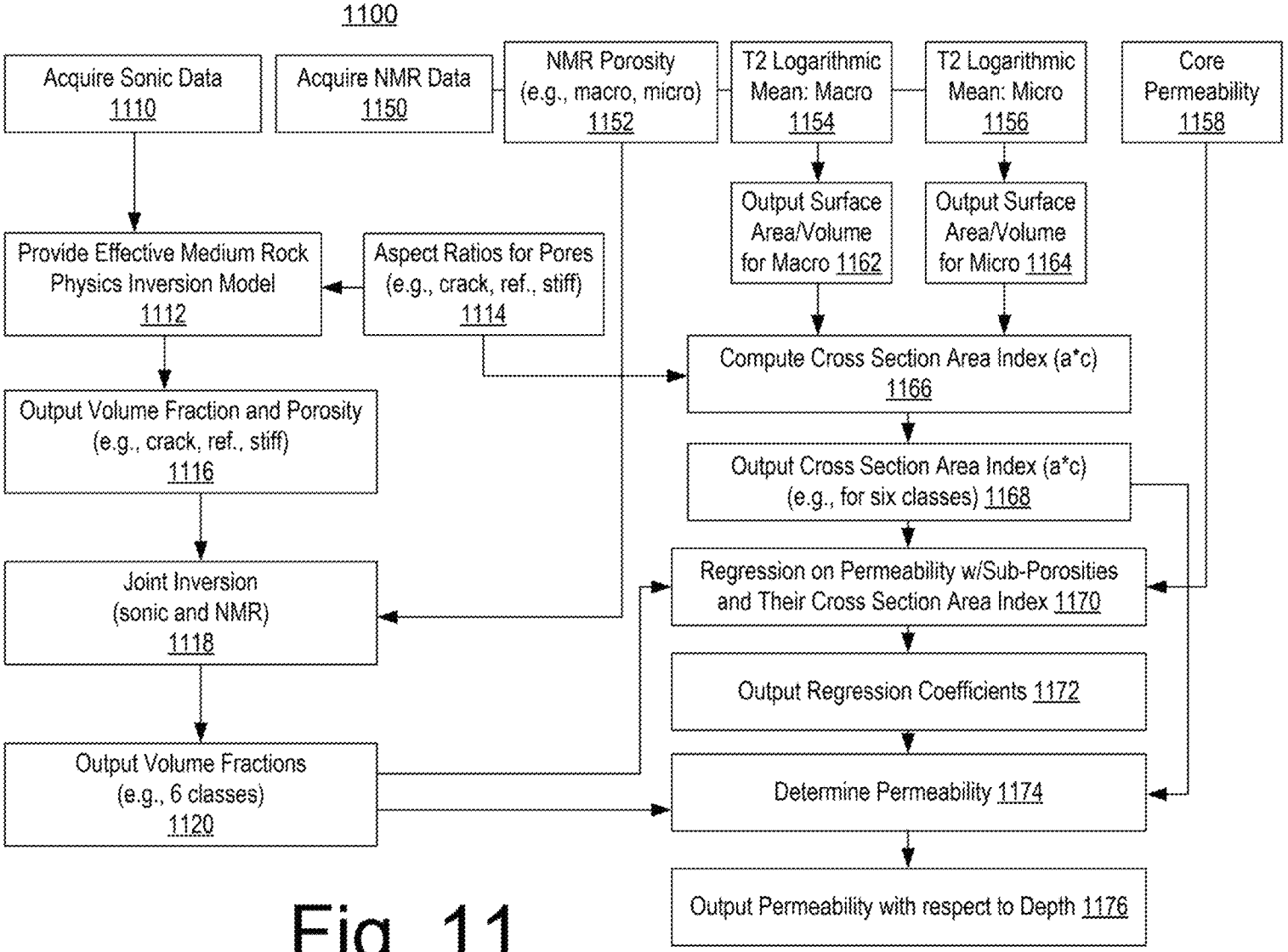
FIG. 11 illustrates an example of a workflow.

FIG. 11 shows an example of a workflow 1100 that includes acquisition blocks 1110 and 1150 for acquiring sonic data and acquiring NMR data, respectively. As shown, a provision block 1112 may provide an effective medium rock physics inversion model, which may be informed by aspect ratios for pores block 1114, which may, for example, define crack, reference and stiff types of pores. The inversion model may be used to generate output per an output block 1116 for volume fraction and porosity according to the aspect ratios block 1114. As shown, the acquisition block 1150 may provide for NMR porosity 1152, for example, for classes such as macro and micro, which may be utilized together with the volume fraction and porosity of the output block 1116 to perform a joint inversion per a joint inversion block 1118. Thus, the workflow 1100 may utilized data acquired per the acquisition blocks 1110 and 1150, together with definitions (e.g., classes) to perform a joint inversion per the joint inversion block 1118 to output volume fractions for at least one of the classes, which may include volume fractions for all of the classes per the output block 1120.

As shown in the example of FIG. 11, the workflow 1100 may utilize the volume fractions of the output block 1120 for permeability computations. The permeability computations may utilize T2 logarithmic mean for a first class (e.g., macro) 1154 and T2 logarithmic mean for a second class (e.g., micro) 1156 to generate output per the output blocks 1162 and 1164, which are for surface area to volume ratio for the first class and the second class, respectively.

As shown in the example of FIG. 11, a compute block 1166 may use the output of the blocks 1162 and 1164 for computing a cross section area index, for example, using parameters "a" and "c" of a suitable geometric model (e.g., an oblate spheroid, etc.), along with information from the block 1114 (e.g., as to classes such as crack, reference and stiff). An output block 1168 may output the cross-section area index for the groups (e.g., classes) to a permeability determination block 1174 and to a regression on permeability with sub-porosities and their cross-section area index block 1170. As shown, the blocks 1170 and 1174 may receive output volume fractions for classes from the block 1120. As shown, the block 1170 may also receive core permeability information (e.g., using sample cores, laboratory cores, etc.) per a core permeability block 1158 where the block 1170 may output regression coefficients per an output block 1172 that may be received by the permeability determination block 1174. As explained, permeability may be determined, for example, with respect to depth (e.g., measured depth) in a borehole via the block 1174 and output per an output block 1176. In such an example, a formation may be characterized with respect to its permeability, which may provide for stratigraphic associated permeability of a subsurface geologic region or regions, depending on a trajectory of a borehole and/or how the output may be combined with output from one or more other sources (e.g., one or more other boreholes). As to a specific borehole, information on permeability may pertain to borehole wall permeability, which may be near-wall permeability of a region that is adjacent to and/or that forms a borehole. As an example, output may be utilized to characterize borehole condition, which may include aspects of integrity. As an example, output may be utilized to characterize a formation, which may be a reservoir formation, for example, to determine where to perforate a tubing for purposes of flow into and/or flow out of the tubing, to determine where to fracture a reservoir formation, etc.

As an example, a method may include:

1) Acquiring a sonic log in a borehole.
2) Computing volume fractions of crack, reference and stiff pores through inversion of an effective medium rock physics model.
3) With adding micro porosity and macro porosity from NMR factor analysis, volume fractions of six pore groups (e.g., micro crack, micro reference, micro stiff, macro crack, macro reference, macro stiff) may be determined by joint inversion.
4) T2 logarithmic mean for micro pores and macro pores may be computed, for example, based on cutoff value determined through factor analysis.
5) Pore surface area to volume ratio for micro pores and macro pores may be computed individually from T2 logarithmic means.
6) Semi long axis (a), semi short axis (c) and cross section area index (a*c) for six pore groups may be computed (e.g., using a suitable geometric model).
7) Regression may be performed using core permeability with total porosity, volume fractions and cross section area index (a*c) of six pore groups, to determine regression coefficients.
8) Using regression coefficients together with total porosity, volume fractions and cross section area index (a*c) of six pore groups for estimation of permeability for the same borehole at other depths in the borehole, optionally without resorting to core data.

Figure 12:
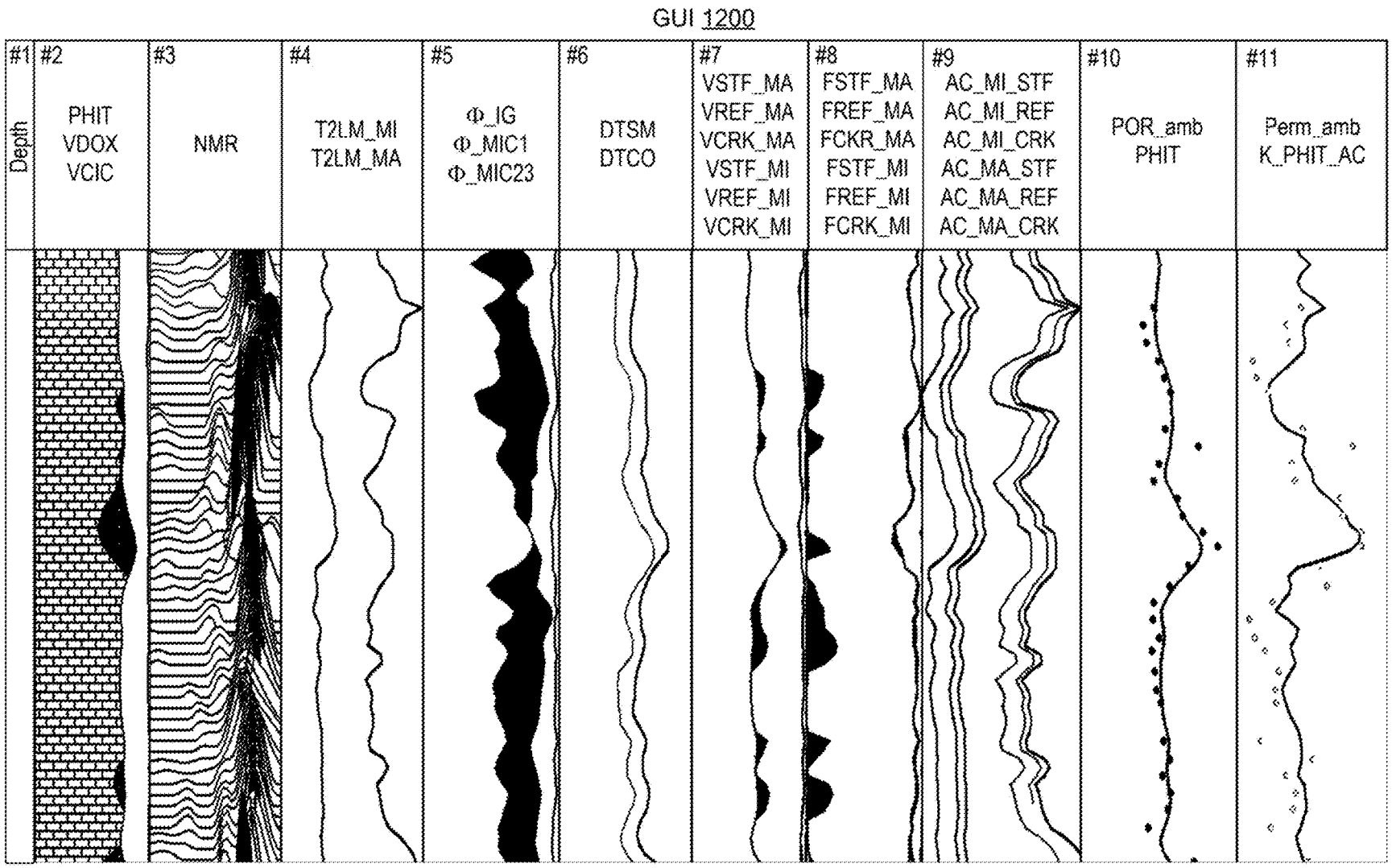
FIG. 12 illustrates an example of a graphical user interface.

FIG. 12 shows an example GUI 1200 that includes various tracks that may include input and output tracks of a workflow such as, for example, the workflow 1100 of FIG. 11. In the GUI 1200, the following tracks are included: Track #1: depth; Track #2: lithology; Track #3: NMR T2 distribution; Track #4: T2 logarithmic mean for macro porosity and micro porosity; Track #5: macro and micro porosity from NMR Factor Analysis; Track #6: measured compressional and shear slowness from sonic data; Track #7: porosity of six pore types from sonic and NMR integration; Track #8: volume fraction of six pore types from sonic and NMR integration; Track #9: cross section area index of six pore types from sonic and NMR; Track #10: total porosity from log and core data; and Track #11: permeability from regression and core data.

As an example, a method may include using NMR factor analysis, CIPHER, and/or one or more other techniques for micro porosity and macro porosity and/or one or more other suitable classes. CIPHER processing is a time-domain NMR analysis.

As to factor analysis, it may provide for determining poro-fluid distributions and associated porosities in clastic and carbonate reservoirs. For example, it may provide answers to questions concerning 1) how many formation components the T2 distribution truly represents; 2) the T2 limits of these components; and 3) the underlying pore size distribution and fluid types affecting bound/free fluid T2 cutoff, poro-fluid facies classification, and capillary-height conversion.

A factor analysis workflow may include checking the quality of the input T2 distribution matrix. The T2 distribution matrix may be used to construct a correlation (or covariance) matrix. The correlation matrix provides some initial insight into the inverted T2 distributions. For instance, a heat map of the correlation matrix may be used to determine an approximate estimate of clay and capillary bound water. Next, the number of factors affecting the T2 distribution may be determined. The initial number of factors may be estimated using mathematical/statistical techniques such as, for example, principal component analysis (PCA) (e.g., number of significant principal components) may be used as an initial estimate of number of factors present in a dataset and/or eigenvalues and cumulative variance plots may be used to determine the most significant principal components; Horn's parallel analysis (e.g., generation of random variables to determine number of factors to retain, which may use Monte Carlo simulations); etc.

As an example, in factor analysis, a correlation matrix of the T2 distribution may be factorized into a determined number of factors to produce a factor loading matrix. The factor loading matrix may be rotated, orthogonally or obliquely, to achieve a pattern of loadings where measured variables (T2 components) load most strongly on one factor and much more weakly on others. As an example, each column in the squared and normalized factor loading matrix may represent a signature T2 distribution of a single underlying poro-fluid constituent. As an example, Gaussian peaks may be fitted over each factor signature to aid interpretation (e.g., manual, automated, semi-automated, etc.). Iteration on the number of factors, factorization method, and rotation may be performed to optimize signatures (factors).

As an example, a method to determine T2 cutoffs for binned porosities may be utilized where NMR T2 distributions may be partitioned into porosity bins by applying cutoffs. As an example, a factor analysis workflow may be utilized for determination of cutoffs and hence binning. Factor analysis may be performed for a number of datasets; noting that universal T2 cutoffs or distributions for siliciclastic or carbonate environments do not generally exist. In an individual well, factor analysis may be applied to determine binned porosity T2 cutoffs.

As an example, a method may provide for integrating NMR and sonic measurements to partition the total porosity in carbonate rocks into six pore groups (micro crack, micro reference, micro stiff, macro crack, macro reference, macro stiff). As an example, a method may provide for estimating cross section area index and volume fraction of six pore groups. As an example, a method may provide for estimating the permeability through cross section area index and volume fraction of the six pore groups. As an example, a method may provide for integrating NMR, sonic and other physics measurements such as dielectric dispersion, neutron, resistivity to partition the total porosity in carbonate rocks into six pore groups (micro crack, micro reference, micro stiff, macro crack, macro reference, macro stiff).

As an example, a system, a method, etc., may utilize one or more types of ML models. As to examples of some types of ML models, consider one or more of a support vector machine (SVM) model, a k-nearest neighbors (KNN) model, an ensemble classifier model, a neural network (NN) model, etc. As an example, a ML model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a ML model may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange with various other frameworks.

As an example, the TENSORFLOW framework (Google LLC, Mountain View, CA) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method may include various actions that may operate on a dataset to train a ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, a device may utilize TENSORFLOW LITE (TFL) or another type of lightweight framework. TFL is a set of tools that enables on-device machine learning where models may run on mobile, embedded, and IoT devices. TFL is optimized for on-device machine learning, by addressing latency (no round-trip to a server), privacy (no personal data leaves the device), connectivity (Internet connectivity is demanded), size (reduced model and binary size) and power consumption (e.g., efficient inference and a lack of network connections). TFL has multiple platform support, covering ANDROID and iOS devices, embedded LINUX, and microcontrollers. TFL has diverse language support, which includes JAVA, SWIFT, Objective-C, C++, and PYTHON. TFL has high performance, with hardware acceleration and model optimization. Various machine learning tasks may include, for example, one or more of image classification, object detection, pose estimation, question answering, text classification, regression, prediction, etc., on one or more platforms.

As an example, one or more ML models may be utilized for purposes of classifying. For example, consider one or more ML models that may provide for classifying data to determine volume fractions and/or permeabilities using classes, which may include classes based on NMR data and sonic data.

Figure 13:
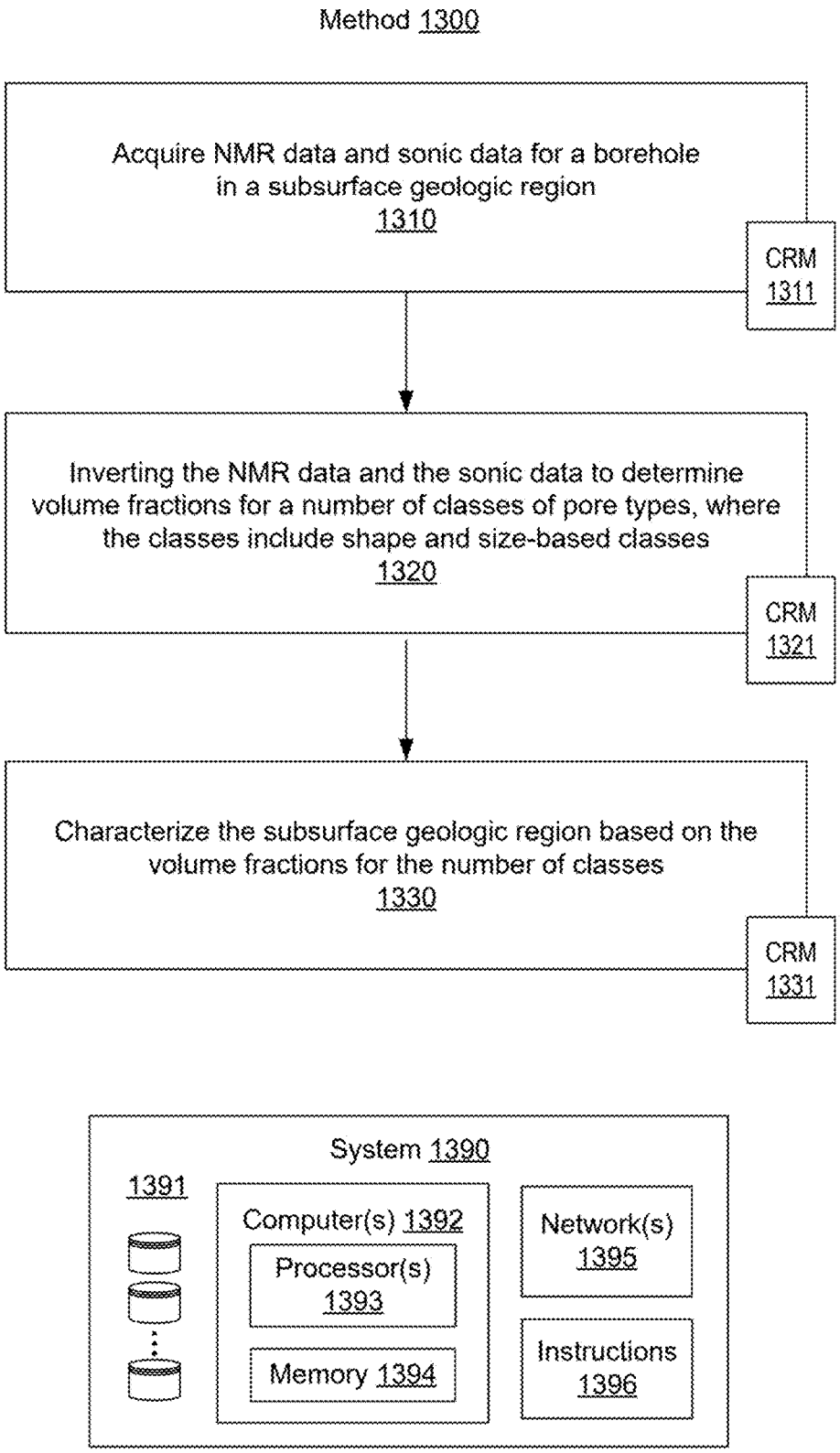
FIG. 13 illustrates an example of a method and an example of a system.

FIG. 13 shows an example of a method 1300 and an example of a system 1390. As shown, the method 1300 may include an acquisition block 1310 for acquiring NMR data and sonic data for a borehole in a subsurface geologic region; an inversion block 1320 for inverting the NMR data and the sonic data to determine volume fractions for a number of classes of pore types, where the classes include shape and size-based classes; and a characterization block 1330 for characterizing the subsurface geologic region based on the volume fractions for the number of classes.

In the example of FIG. 13, the system 1390 includes one or more information storage devices 1391, one or more computers 1392, one or more networks 1395 and instructions 1396. As to the one or more computers 1392, each computer may include one or more processors (e.g., or processing cores) 1393 and memory 1394 for storing the instructions 1396, for example, executable by at least one of the one or more processors. As an example, a computer may include one or more network interfaces (e.g., wired or wireless), one or more graphics cards, a display interface (e.g., wired or wireless), etc.

The method 1300 is shown along with various computer-readable media blocks 1311, 1321 and 1331 (e.g., CRM blocks). Such blocks may be utilized to perform one or more actions of the method 1300. For example, consider the system 1390 of FIG. 13 and the instructions 1396, which may include instructions of one or more of the CRM blocks 1311, 1321 and 1331.

As an example, a method may include acquiring NMR data and sonic data for a borehole in a subsurface geologic region; inverting the NMR data and the sonic data to determine volume fractions for a number of classes of pore types, where the classes include shape and size-based classes; and characterizing the subsurface geologic region based on the volume fractions for the number of classes. In such an example, the method may include determining volume fractions and porosity using the sonic data, where inverting utilizes the volume fractions and porosity.

As an example, determining volume fractions and porosity may include using an effective medium rock physics model. As an example, porosity may include pre-defined pore shape-based classes. For example, consider pre-defined pore shape-based classes that include a crack class, a reference class and a stiff class. As an example, pre-defined pore shape-based classes may span a range of shape-based aspect ratios. For example, a thin shape may be a crack class and a 1:1 shape may be a stiff class, where a shape in between the thin and 1:1 shape may be a reference class.

As an example, a method may include determining pore size-based classes using NMR data where, for example, pore size-based classes may include a small size class and a large size class (e.g., classes of different sizes).

As an example, classes may include six classes that are based on two sizes and three shapes. In such an example, two multiplied by three equals six; hence, six classes may be defined that are shape and size-based classes.

As an example, a method may include determining pore cross section area for one or more classes. In such an example, the pore cross section area may be based on a geometric model. For example, consider an oblate spheroid model.

As an example, a method may include characterizing a subsurface geologic region based on volume fractions for a number of classes by computing permeability of at least a portion of the subsurface geologic region. For example, consider computing permeability values with respect to distance along at least a portion of a borehole.

As an example, a method may include acquiring data by moving a tool string that may include a sonic tool, an NMR tool or a sonic tool and an NMR tool where the tool string is moved in a borehole, which may be part of a wireline operation, a drilling operation, etc. As an example, a method may include controlling movement of a tool string based at least in part on inverting sonic data and NMR data. As an example, a tool string may be a wireline string or a drillstring. As an example, a method may include controlling one or more drilling operations based at least in part on inverting sonic and NMR data where at least a portion of the data may be acquired using a drillstring for one of the one or more drilling operations. As an example, a method may be a real-time method for controlling acquisition of data using a downhole tool or downhole tools, which, as mentioned, may be part of a wireline or a drillstring. As an example, drilling may be controlled based on one or more pore system characterizations. For example, consider switching from one drill bit to another drill bit, changing mud density, changing mud flow rate, changing RPM, changing hole size, etc.

As an example, a system may include a processor; memory accessible to the processor; processor-executable instructions stored in the memory and executable by the processor to instruct the system to: acquire NMR data and sonic data for a borehole in a subsurface geologic region; invert the NMR data and the sonic data to determine volume fractions for a number of classes of pore types, where the classes include shape and size-based classes; and characterize the subsurface geologic region based on the volume fractions for the number of classes.

As an example, one or more computer-readable media may include computer-executable instructions executable by a system to instruct the system to: acquire NMR data and sonic data for a borehole in a subsurface geologic region; invert the NMR data and the sonic data to determine volume fractions for a number of classes of pore types, where the classes include shape and size-based classes; and characterize the subsurface geologic region based on the volume fractions for the number of classes.

As an example, a computer program product may include one or more computer-readable storage media that may include processor-executable instructions to instruct a computing system to perform one or more methods and/or one or more portions of a method.

Figure 14:
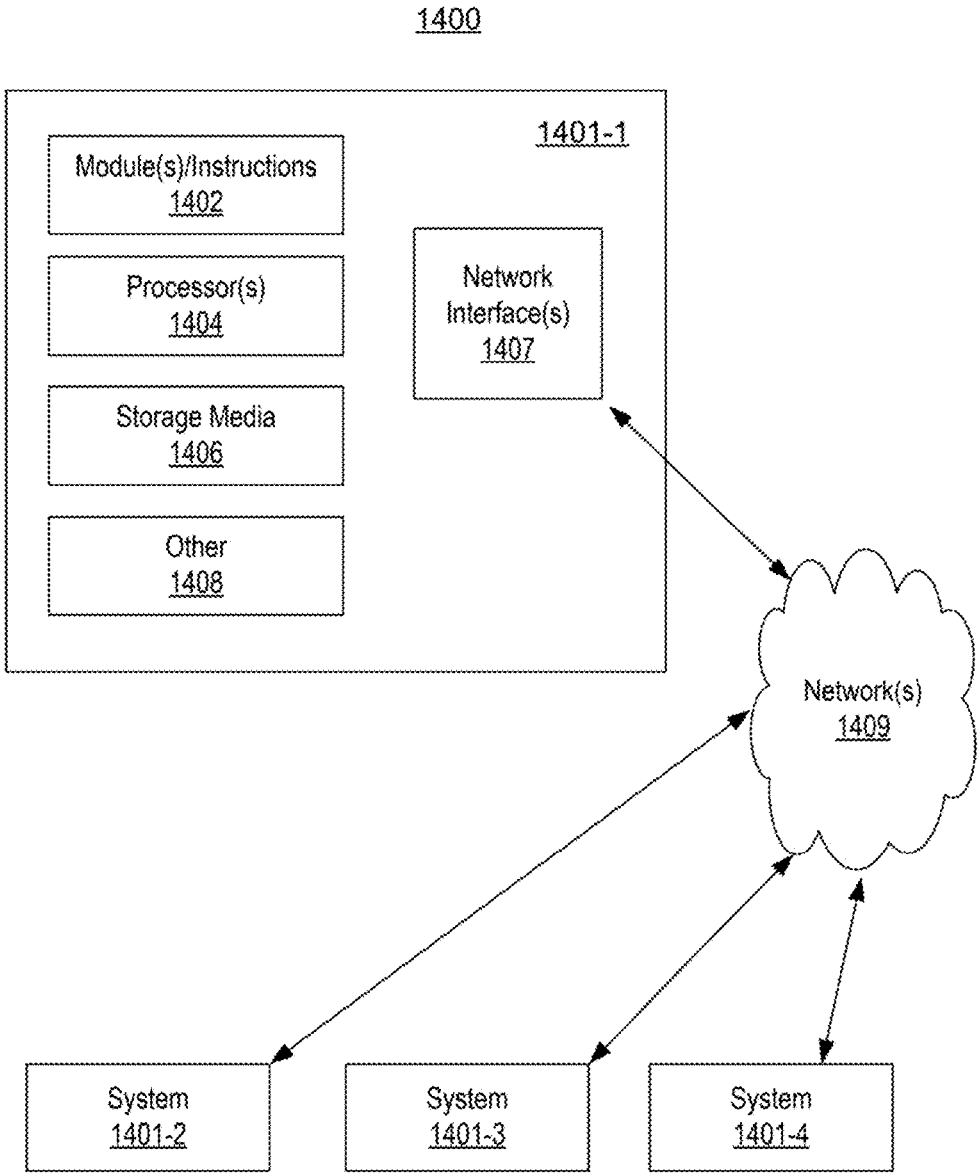
FIG. 14 illustrates examples of computer and network equipment.

In some embodiments, a method or methods may be executed by a computing system. FIG. 14 shows an example of a system 1400 that may include one or more computing systems 1401-1, 1401-2, 1401-3 and 1401-4, which may be operatively coupled via one or more networks 1409, which may include wired and/or wireless networks. As shown, one or more other components 1408 may be included in the system 1400.

As an example, a system may include an individual computer system or an arrangement of distributed computer systems. In the example of FIG. 14, the computer system 1401-1 may include one or more modules 1402, which may be or include processor-executable instructions, for example, executable to perform various tasks (e.g., receiving information, requesting information, processing information, simulation, outputting information, etc.).

As an example, a module may be executed independently, or in coordination with, one or more processors 1404, which is (or are) operatively coupled to one or more storage media 1406 (e.g., via wire, wirelessly, etc.). As an example, one or more of the one or more processors 1404 may be operatively coupled to at least one of one or more network interface 1407. In such an example, the computer system 1401-1 may transmit and/or receive information, for example, via the one or more networks 1409 (e.g., consider one or more of the Internet, a private network, a cellular network, a satellite network, etc.).

As an example, the computer system 1401-1 may receive from and/or transmit information to one or more other devices, which may be or include, for example, one or more of the computer systems 1401-2, etc. A device may be located in a physical location that differs from that of the computer system 1401-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1406 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

DOCUMENTS INCORPORATED BY REFERENCE HEREIN

Jain, V., Minh, C. C., Heaton, N., Ferraris, P., Ortenzi, L. and Ribeiro, M. T., 2013, June. Characterization of underlying pore and fluid structure using factor analysis on NMR data. In SPWLA 54th Annual Logging Symposium.

Clerke, E. A., Allen, D. F., Crary, S. C., Srivastava, A., Ramamoorthy, R., Saldungaray, P., Savundararaj, P., Heliot, D., Goswami, J. and Bordakov, G., 2014, May. Wireline spectral porosity analysis of the Arab Limestone—From Rosetta Stone to CIPHER. In SPWLA 55th Annual Logging Symposium.

Xu, S. and Payne, M. A., 2009. Modeling elastic properties in carbonate rocks. The Leading Edge, 28(1), pp.66-74.

Mehrabi, Mozhdeh & Pasha, Mehrdad & Hassanpour, Ali & Glover, Paul & Jia, Xiaodong. (2017). Imaging and quantification of the pore microstructure of gas shales using X-ray microtomography. Solid Earth Discussions. 1-17. 10.5194/ se-2017-52.

What is claimed is:

1. A method, comprising:

acquiring nuclear magnetic resonance (NMR) data and sonic data for a borehole in a subsurface geologic region using a tool string disposed in the borehole;

determining, from the sonic data by inverting an effective medium rock physics model using acoustic compressional and shear measurements:

volume fractions of crack pores, reference pores, and stiff pores; and pore aspect ratios for the crack pores, the reference pores, and the stiff pores;

determining, from the NMR data, micro porosity and macro porosity by NMR factor analysis or Classification and Inversion of Pore-scale Hydrogen Environments for Reservoir evaluation (CIPHER) processing;

jointly inverting the NMR data and the sonic data, using the volume fractions of the crack pores, the reference pores, and the stiff pores and using the micro porosity and the macro porosity, to determine volume fractions for six pore groups comprising micro crack, micro reference, micro stiff, macro crack, macro reference, and macro stiff;

computing a T2 logarithmic mean for the micro porosity and a T2 logarithmic mean for the macro porosity;

computing a pore surface area-to-volume ratio for micro pores and a pore surface area-to-volume ratio for macro pores from the T2 logarithmic mean for the micro porosity and the T2 logarithmic mean for the macro porosity;

computing, for each of the six pore groups, pore geometry parameters comprising a semi-long axis, a semi-short axis, and a cross-section area index using the pore aspect ratios and the pore surface area-to-volume ratios, the computing the semi-long axis, the semi-short axis, and the cross-section area index comprising using an oblate spheroid geometric model;

determining regression coefficients by performing regression using core permeability data with total porosity, the volume fractions of the six pore groups, and the cross-section area index for the six pore groups;

computing, using the regression coefficients, permeability values with respect to depth along at least a portion of the borehole; and controlling movement of the tool string in the at least a portion of the borehole based at least in part on the computed permeability values.

2. The method of claim 1, wherein the determining the volume fractions of crack pores, reference pores, and stiff pores comprises inverting the effective medium rock physics model using acoustic compressional slowness and acoustic shear slowness measurements.

3. The method of claim 2, wherein the total porosity comprises pre-defined pore shape-based classes.

4. The method of claim 3, wherein the pre-defined pore shape-based classes comprise a crack class, a reference class, and a stiff class.

5. The method of claim 3, wherein the pre-defined pore shape-based classes span a range of shape-based aspect ratios.

6. The method of claim 3, further comprising determining pore size-based classes using the NMR data.

7. The method of claim 6, wherein the pore size-based classes comprise a small size class and a large size class.

8. The method of claim 3, wherein the classes comprise six classes that are based on two sizes and three shapes.

9. The method of claim 3, further comprising determining a pore cross-section area for one or more of the classes.

10. The method of claim 9, wherein the pore cross-section area is based on a geometric model.

11. The method of claim 10, wherein the geometric model comprises an oblate spheroid model.

12. The method of claim 1, wherein the tool string comprises at least one of: a sonic data collection tool or an NMR data collection tool.

13. The method of claim 12, further comprising controlling the movement of the tool string based at least in part on the inverting the NMR data and the sonic data.

14. The method of claim 12, wherein the tool string further comprises a wireline string or a drillstring.

15. The method of claim 14, wherein:

the tool string comprises the drillstring; and the method further comprises controlling one or more drilling operations based at least in part on the inverting the NMR data and the sonic data.

16. The method of claim 1, wherein controlling movement of the tool string comprises adjusting a speed parameter for acquiring NMR measurements at different depths per unit time based on the computed permeability values.

17. The method of claim 1, wherein the determining the micro porosity and the macro porosity comprises performing NMR factor analysis on a T2 relaxation-time distribution.

18. The method of claim 1, wherein the determining the micro porosity and the macro porosity comprises performing CIPHER processing on the NMR data.

19. The method of claim 1, wherein the jointly inverting the NMR data and the sonic data comprises simultaneously constraining the inversion using the pore aspect ratios, the micro porosity, and the macro porosity.

20. A system, comprising:

a processor;

memory accessible to the processor; and processor-executable instructions stored in the memory and executable by the processor to instruct the system to:

acquire nuclear magnetic resonance (NMR) data and sonic data for a borehole in a subsurface geologic region using a tool string disposed in the borehole;

determine, from the sonic data by inverting an effective medium rock physics model using acoustic compressional and shear measurements:

volume fractions of crack pores, reference pores, and stiff pores; and pore aspect ratios for the crack pores, the reference pores, and the stiff pores;

determine, from the NMR data, micro porosity and macro porosity by NMR factor analysis or Classification and Inversion of Pore-scale Hydrogen Environments for Reservoir evaluation (CIPHER) processing;

jointly invert the NMR data and the sonic data, using the volume fractions of the crack pores, the reference pores, and the stiff pores and using the micro porosity and the macro porosity, to determine volume fractions for six pore groups comprising micro crack, micro reference, micro stiff, macro crack, macro reference, and macro stiff;

compute a T2 logarithmic mean for the micro porosity and a T2 logarithmic mean for the macro porosity;

compute a pore surface area-to-volume ratio for micro pores and a pore surface area-to-volume ratio for macro pores from the T2 logarithmic mean for the micro porosity and the T2 logarithmic mean for the macro porosity;

compute, for each of the six pore groups, pore geometry parameters comprising a semi-long axis, a semi-short axis, and a cross-section area index using the pore aspect ratios and the pore surface area-to-volume ratios, the computing the semi-long axis, the semi-short axis, and the cross-section area index comprising using an oblate spheroid geometric model;

determine regression coefficients by performing regression using core permeability data with total porosity, the volume fractions of the six pore groups, and the cross-section area index for the six pore groups;

compute, using the regression coefficients, permeability values with respect to depth along at least a portion of the borehole; and control movement of the tool string in the at least a portion of the borehole based at least in part on the computed permeability values.

21. One or more computer-readable media comprising computer-executable instructions executable by a system to instruct the system to:

acquire nuclear magnetic resonance (NMR) data and sonic data for a borehole in a subsurface geologic region using a tool string disposed in the borehole;

determine, from the sonic data by inverting an effective medium rock physics model using acoustic compressional and shear measurements:

volume fractions of crack pores, reference pores, and stiff pores; and pore aspect ratios for the crack pores, the reference pores, and the stiff pores;

determine, from the NMR data, micro porosity and macro porosity by NMR factor analysis or Classification and Inversion of Pore-scale Hydrogen Environments for Reservoir evaluation (CIPHER) processing;

jointly invert the NMR data and the sonic data, using the volume fractions of the crack pores, the reference pores, and the stiff pores and using the micro porosity and the macro porosity, to determine volume fractions for six pore groups comprising micro crack, micro reference, micro stiff, macro crack, macro reference, and macro stiff;

compute a T2 logarithmic mean for the micro porosity and a T2 logarithmic mean for the macro porosity:

compute a pore surface area-to-volume ratio for micro pores and a pore surface area-to-volume ratio for macro pores from the T2 logarithmic mean for the micro porosity and the T2 logarithmic mean for the macro porosity;

compute, for each of the six pore groups, pore geometry parameters comprising a semi-long axis, a semi-short axis, and a cross-section area index using the pore aspect ratios and the pore surface area-to-volume ratios, the computing the semi-long axis, the semi-short axis, and the cross-section area index comprising using an oblate spheroid geometric model;

determine regression coefficients by performing regression using core permeability data with total porosity, the volume fractions of the six pore groups, and the cross-section area index for the six pore groups;

compute, using the regression coefficients, permeability values with respect to depth along at least a portion of the borehole; and control movement of the tool string in the at least a portion of the borehole based at least in part on the computed permeability values.

* * * * *